US008412370B2

(12) United States Patent
Tanaka et al.

(10) Patent No.: US 8,412,370 B2
(45) Date of Patent: Apr. 2, 2013

(54) POLISHING APPARATUS WITH DRESSING POSITION SETTING MEANS

(75) Inventors: Toshihisa Tanaka, Yokohama (JP); Atsushi Tanaka, Fuchu (JP); Yuko Kitade, Saitama-ken (JP)

(73) Assignee: Nikon Corporation, Tokyo (JP)

( * ) Notice: Subject to any disclaimer, the term of this patent is extended or adjusted under 35 U.S.C. 154(b) by 795 days.

(21) Appl. No.: 11/887,454

(22) PCT Filed: Mar. 23, 2006

(86) PCT No.: PCT/JP2006/306591

§ 371 (c)(1),
(2), (4) Date: Sep. 18, 2009

(87) PCT Pub. No.: WO2006/106790

PCT Pub. Date: Oct. 12, 2006

(65) Prior Publication Data

US 2010/0035520 A1 Feb. 11, 2010

(30) Foreign Application Priority Data

Apr. 1, 2005 (JP) ..... 2005-106049
Apr. 1, 2005 (JP) ..... 2005-106050

(51) Int. Cl.
*G06F 19/00* (2011.01)

(52) U.S. Cl. ..... 700/164; 451/443

(58) Field of Classification Search ..... 700/164; 451/443

See application file for complete search history.

(56) References Cited

U.S. PATENT DOCUMENTS 6,302,772 B1 10/2001 Hosoki
7,500,904 B2 * 3/2009 Minami et al. ..... 451/56
7,686,673 B2 * 3/2010 Senga et al. ..... 451/5
2005/0032467 A1 * 2/2005 Hoshino et al. ..... 451/56

FOREIGN PATENT DOCUMENTS

EP 1 063 056 A2 12/2000

(Continued)

OTHER PUBLICATIONS

Machine Translation of JP 2001-170857.*

(Continued)

*Primary Examiner* — Ryan Jarrett
(74) *Attorney, Agent, or Firm* — Finnegan, Henderson, Farabow, Garrett & Dunner, L.L.P.

(57) ABSTRACT

While data that indicate a relationship between a dressing position P defined by a distance between a rotating shaft 11 of a polishing pad 13 and a rotating shaft 31 of a dresser 30 and shape change of the polishing pad 13 based on input of a target shape of the polishing pad 13 and alternating repetition of dressing the polishing pad 13 by the dresser 30 and measurement of shape of the polishing pad 13 by a pad shape measurement instrument 20 is acquired at a stage prior to commencement of a series of polishing steps for continuously polishing a plurality of polishing target objects (semiconductor wafer W) by a polishing tool 10, the polishing pad 13 is machined to the target shape 13 while the dressing position P is controlled, whereby the dressing position P is set during the polishing steps on the basis of a processing result of this data.

7 Claims, 10 Drawing Sheets

FOREIGN PATENT DOCUMENTS

| | | |
|---|---|---|
| JP | 10-086056 | 4/1998 |
| JP | 11-170155 | 6/1999 |
| JP | 2001-129754 | 5/2001 |
| JP | 2001-170857 | 6/2001 |
| JP | 2002-337046 | 11/2002 |
| JP | 2003-068688 | 3/2003 |
| JP | 2003-071705 | 3/2003 |
| JP | 2003-71705 | 3/2003 |
| JP | 2004-025413 | 1/2004 |

OTHER PUBLICATIONS

Machine Translation of JP 11-170155.*
Machine Translation of JP 2003-71705.*
Machine Translation of JP 2001-129754.*
Notice of Preliminary Rejection issued on Oct. 10, 2012 by the Korean Intellectual Property Office in Korean Patent Application No. 10-2007-7025226, including translation (7 pages total).

* cited by examiner

POLISHING APPARATUS WITH DRESSING POSITION SETTING MEANS

FIELD OF THE INVENTION

The present invention relates to a polishing apparatus for polishing the surface of a polishing target object. The present invention further relates to a method of manufacturing a semiconductor device in use of this polishing apparatus, and to a semiconductor device manufactured by this method of manufacturing a semiconductor device.

BACKGROUND OF THE INVENTION

Polishing apparatuses for polishing the surface of a polishing target object (for example, a semiconductor wafer) comprise a polishing tool on which a polishing pad is mounted and polishing target object holding means such as a rotating support for holding the polishing target object and are configured to polish the surface of the polishing target object as a result of the polishing tool and polishing target object holding means being relatively moved with the polishing pad in a state of contact with the polishing target object held by polishing target object holding means. Polishing target object shavings generated throughout the surface polishing thereof and slurry dregs and so on of a slurry supplied to the surface to be polished of the polishing target object create blockages in the surface of the polishing pad of these polishing apparatuses which, as a result, must be dressed by a separately provided dresser (for example, see Japanese Unexamined Patent Application Publication Nos. H10-86056, 2003-68688 and 2004-25413).

The polishing pad provided on the polishing tool changes the polishing state of the polishing target object in accordance with its shape. In other words, the polishing state of a polishing target object can be adjusted by preparing a polishing pad of a predetermined shape. Accordingly, the polishing pad must be dressed not only to remove blockages of the pad surface but also to form the polishing pad in the aforementioned predetermined shape. The way that a polishing pad is planed changes when the relative position of the dresser with respect to the polishing pad is altered and, accordingly, the polishing pad shape can be gradually caused to approach the predetermined shape by dressing the polishing pad while measuring changes in the surface shape of the polishing pad.

PROBLEMS TO BE SOLVED BY THE INVENTION

However, the conventional operation for finishing a polishing pad to a predetermined shape is a so-called manual operation performed by an operator on the basis of trial and error. Accordingly, shape adjustment of the polishing pad at a stage prior to, the polishing steps (series of steps for continuously polishing a plurality of polishing target objects by a polishing tool) being performed takes time and, on occasion, results in a reduction in the throughput of the polishing steps as a whole. In addition, while the conditions for polishing the polishing target object (various conditions during polishing such as the relative movement speed and polishing time and so on of the polishing pad with respect to the polishing target object) must be individually set in accordance with the polishing pad type and so on, an operator themself must adjudge what type of polishing pad is mounted on the polishing tool in order to set the polishing conditions in this way. For this reason as the throughput of the polishing steps as a whole is sometimes poor.

In addition, because shape adjustment of a polishing pad performed during the course of the polishing steps (series of steps for continuously polishing a plurality of polishing target objects by a polishing tool) conventionally necessitates interruption to the series of polishing steps and then a manual adjustment performed by an operator on the basis of trial and error, the throughput of the polishing steps as a whole is reduced.

SUMMARY OF THE INVENTION

With the foregoing in mind, it is an object of the present invention to provide a polishing apparatus of a configuration that facilitates improved throughput of the polishing steps as a whole, and to a method of manufacturing a semiconductor device employing the polishing apparatus and a semiconductor device manufactured by the method of manufacturing a semiconductor device.

The polishing apparatus pertaining to the present invention comprises: a polishing tool on which a polishing pad is mounted; and polishing target object holding means (for example, rotating support 40 of this embodiment) for holding a polishing target object, and which polishes the surface of the polishing target object by a relative movement of the polishing tool and polishing target object holding means with the polishing pad being in a state of contact with the polishing target object held by polishing target object holding means, and the polishing apparatus further comprises: a dresser for dressing the polishing pad by bringing the rotated dressing surface thereof into contact with the surface of the polishing pad mounted on the polishing tool; pad shape measurement means (for example, pad shape measurement instrument 20 of the embodiments) for measuring the shape of the polishing pad mounted on the polishing tool; pad machining control means for, while acquiring data indicating a relationship between a dressing position defined by the distance between a rotating shaft of the polishing pad and a rotating shaft of the dresser and shape change of the polishing pad based on input of a polishing pad target shape and alternating repetition of polishing pad dressing by the dresser and polishing pad shape measurement by pad shape measurement means at a stage prior to commencement of a series of polishing steps for continuously polishing a plurality of polishing target objects by the polishing tool, machining the polishing pad to the target shape while controlling the dressing position; and dressing position setting means (for example, polishing control unit 60 of the embodiments) for setting the dressing position during the polishing steps based on a processing result of this data.

Here, it is preferable that aforementioned dressing position setting means, based on data illustrating the relationship between dressing position and polishing pad shape change, obtain a dressing position at which the undulation displacement speed of change of the polishing pad is approximately zero and use this dressing position as a criterion to set a dressing position at which polishing pad shape change is minimized. In addition, it is preferable that the aforementioned polishing apparatus comprise pad type detection means (for example, pad type discrimination protrusions 13*a* of the polishing pad 13 and pad shape measurement instrument 20 of the embodiments) for detecting a type of the polishing pad mounted on the polishing tool, and polishing condition setting means (for example, polishing control unit 60 of the embodiments) for setting polishing conditions of the polishing target object in accordance with the polishing pad type detected by pad type detection means. The undulation displacement referred to here is a value obtained by multiplying the distance from the inner diameter to the outer diameter of the polishing pad and a supplement of the conical vertical angle of the surface of the polishing pad.

In this polishing apparatus a step for machining the polishing pad to a preestablished target shape is automatically performed at a stage prior to commencement of a series of polishing steps for continuously polishing a plurality of polishing target objects by the polishing tool and, unlike in the prior art, because of the absence of a step for dressing and finishing a polishing pad to a target shape performed by an operator on the basis of trial and error, polishing pad shape adjustment can be implemented in a short time and the throughput of the polishing steps as a whole can be improved.

Another polishing apparatus pertaining to the present invention for polishing the surface of a polishing target object by a polishing tool on which a polishing pad is mounted comprises: pad type detection means for detecting the polishing pad type mounted on the polishing tool, and polishing condition setting means for setting polishing conditions of the polishing target object in accordance with the polishing pad type detected by pad type detection means.

In addition, it is preferable that the aforementioned polishing apparatus pertaining to the present invention comprises process operation means (for example, process operation unit 70 of the embodiments) for performing process operations such as conveyance of the polishing target object and the polishing pad, and monitoring control means (for example, monitoring control unit 62 of the embodiments) for monitoring the progress state of the polishing steps and executing an actuation control of process operation means in accordance with the progress state of the polishing steps.

In this polishing apparatus the polishing pad type is automatically discriminated and the conditions (for example, various conditions during polishing such as the relative movement speed and polishing time and so on of the polishing pad with respect to the polishing target object) for polishing the polishing target object in response thereto are automatically set and, unlike in the prior art, because of the absence of a step based on discrimination of polishing pad type and so on by an operator and setting polishing conditions in response thereto, the throughput of the polishing steps as a whole can be improved.

A further polishing apparatus pertaining to the present invention which comprises a polishing tool on which a polishing pad is mounted and a polishing target object holding means (for example, rotating support 40 of the embodiments) for holding a polishing target object and which polishes the surface of the polishing target object as a result of a relative movement of the polishing tool and polishing target object holding means with the polishing pad in a state of contact with the polishing target object held by polishing target object holding means, comprises: a dresser for dressing the polishing pad as a result of a rotated dressing surface thereof being brought into contact with the surface of the polishing pad mounted on the polishing tool; pad shape measurement means (for example, pad shape measurement instrument 20 of the embodiments) for measuring the shape of the polishing pad mounted on the polishing tool; dressing control means (for example, polishing control unit 60 of the embodiments) for dressing the polishing pad by the dresser in an intermediate process in a series of polishing steps for continuously polishing a plurality of polishing target objects by a polishing tool every time polish of one or a plurality of polishing target objects is completed; and dressing position control means (for example, measurement control unit 61 and polishing control unit 60 of the embodiments), in use of pad shape measurement means, for measuring the shape of the polishing pad every time polish of a predetermined number of polishing target objects is completed, and controlling the dresser position with respect to the polishing pad so that the shape of the polishing pad obtained by the shape measurement of the polishing pad approaches a preestablished polishing pad target shape.

It is preferable that this polishing apparatus comprises process operation means (for example, process operation unit 70 of the embodiments) for performing process operations such as conveyance of the polishing target object and the polishing pad, and monitoring control means (for example, monitoring control unit 62 of this embodiment) for monitoring the progress state of the polishing steps and executing an actuation control of process operation means in accordance with the progress state of the polishing steps.

In this polishing apparatus the step for machining the polishing pad to a preestablished target shape is automatically performed as an intermediate process in a series of polishing steps for continuously polishing a plurality of polishing target objects by a polishing tool and, unlike in the prior art, because of the absence of a step for finishing to a target shape based on the polishing steps being interrupted and then the polishing pad being dressed by an operator on the basis of trial and error with the polishing steps of the polishing apparatus being interrupted, the polishing pad shape adjustment can be performed in a short time and the throughput of the polishing steps as a whole can be improved.

The method of manufacturing a semiconductor device pertaining to the present invention comprises a step for smoothing the surface of a semiconductor wafer that serves as the polishing target object employing the polishing apparatus pertaining to the present invention. Furthermore, the semiconductor device of the present invention is manufactured in according to the abovementioned semiconductor device manufacturing method.

Because this method of manufacturing a semiconductor device employs the polishing apparatus pertaining to the present invention in the step for polishing the semiconductor wafer, the throughput of the steps for polishing the semiconductor wafer is improved, and the semiconductor can be manufactured at lower cost than by a conventional method of manufacturing a semiconductor device. In addition, because the semiconductor device pertaining to the present invention is manufactured by the method of manufacturing a semiconductor device pertaining to the present invention, a low cost semiconductor device is produced.

DESCRIPTION OF THE PREFERRED EMBODIMENTS

Figure 1:
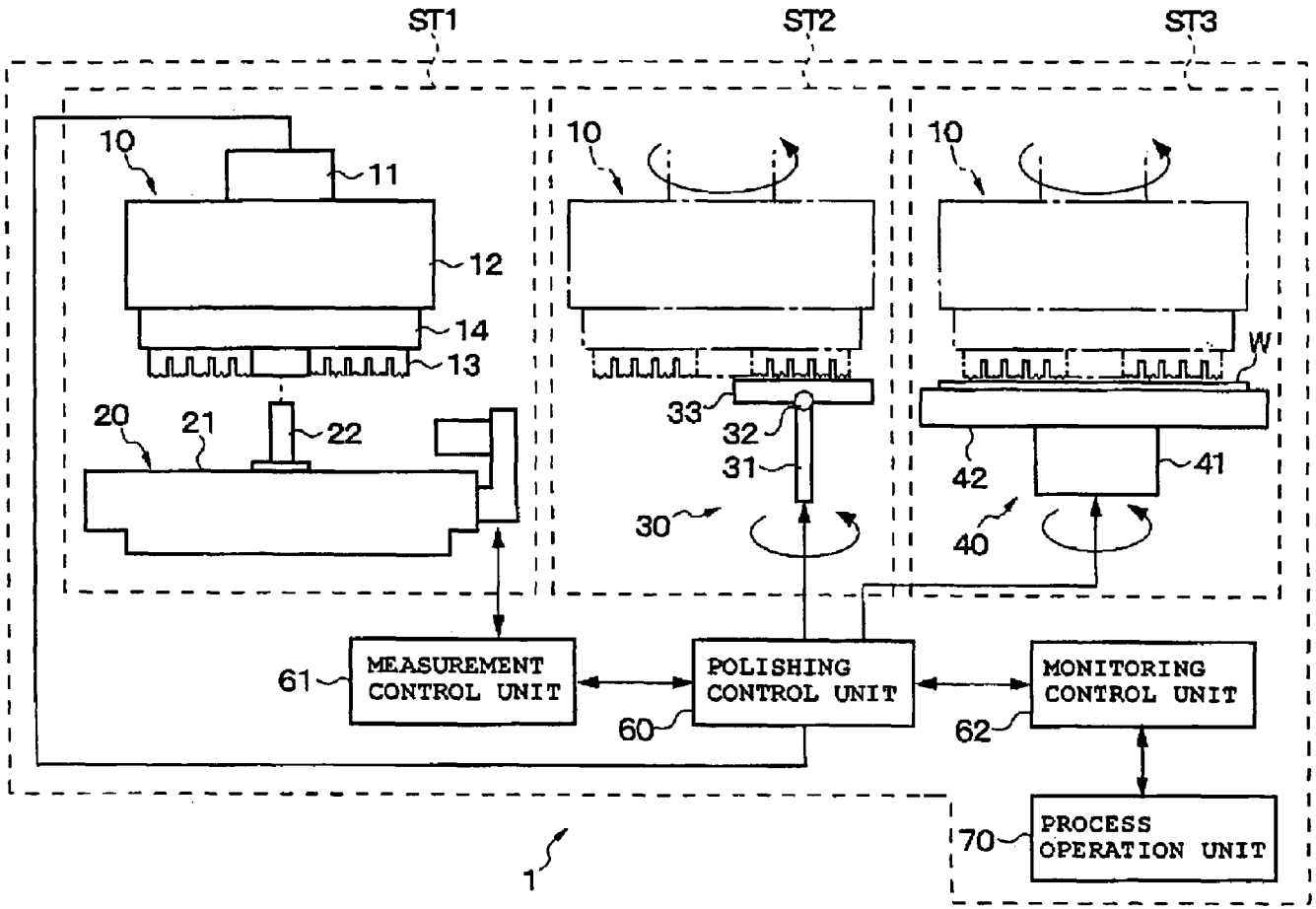
FIG. 1 is a schematic block diagram of the configuration of an embodiment of the polishing apparatus pertaining to the present invention.

Preferred embodiments of the present invention will be hereinafter described with reference to the drawings. FIG. 1 shows a polishing apparatus 1 pertaining to an embodiment of the present invention. The polishing apparatus 1 is configured from, in addition to a polishing tool 10 for polishing a polishing target object, a dresser 30 for dressing a polishing pad 13 mounted on the polishing tool 10, a rotating support 40 for holding the polishing target object, a pad shape measurement instrument 20 for measuring the shape of the polishing pad 13 and a process operation unit 70 for performing process operations such as conveyance of the polishing target object or polishing pad 13, control units for executing the operating control thereof (polishing control unit 60, measurement control unit 61, monitoring control unit 62). In addition, the polishing apparatus 1 comprises three operating stations, that is, a pad shape measurement station ST1, a dressing station ST2 and a polishing station ST3, the polishing tool 10 being able to be moved between the three operating stations ST1, ST2 and ST3. In the description that follows the polishing target object is taken tote a semiconductor wafer, and the polishing apparatus 1 is taken to be a CMP apparatus for chemo-mechanical polishing the surface of the semiconductor wafer.

The polishing tool 10 comprises a rotating shaft 11 extending in the vertical direction, and a tool main body 12 mounted on a lower end part of this rotating shaft 11, the aforementioned polishing pad 13 being affixed to a plate 14 using a double-sided tape or the like whereby the plate 14 and polishing pad 13 are integrally operated. The plate 14 is vacuum-suctioned onto the tool main body 12 so that the polishing pad 13, together with the plate 14, is replaceably mounted. The polishing pad 13 is configured from a foamed polyurethane or the like of, for example, a simple disc shape or a thin donut-like shape with a hole in the center. In this embodiment, the polishing pad 13 is taken to have a thin donut-like shape (see FIG. 2). The rotation control of the rotating shaft 11 of the polishing tool 10 is executed by way of a motor not shown in the diagram, the drive control of this motor being performed by the polishing control unit 60.

The pad shape measurement station ST1 constitutes an operating station at which measurement of the shape of the polishing pad 13 is performed, and the pad shape measurement instrument 20 is able to be positioned below the polishing tool 10 moved to the pad shape measurement station ST1. The pad shape measurement instrument 20 is configured from a sensor supporting part 21 and a sensor 22 supported by this sensor supporting part 21, the sensor 22 being movable in the horizontal plane with respect to the sensor supporting part 21. The sensor 22 is configured from an optical (that is to say, noncontact-type) displacement sensor comprising a photo-emitting element and photoreceiving element and, reflecting an emitted light spot on a measurement position on the polishing pad 13, is able to measure the distance between the pad shape measurement instrument 20 and the measurement position on the polishing pad 13 from position shift of a reflection spot of this light. Accordingly, the relative height of different displacement positions on the polishing pad 13 can be calculated using this pad shape measurement instrument 20. Moreover, while the sensor 22 of the embodiments is taken to be an optical displacement sensor this is an exemplary example only and, while as a noncontact-type sensor an ultrasonic-type displacement sensor or the like may be used while, as a contact-type sensor a probe-employing sensor or the like may be used. The relative movement control of the sensor 22 with respect to the sensor supporting part 21 is performed by way of a motor not shown in the diagram, the drive control of this motor being performed by the polishing control unit 60 and measurement control unit 61 linked therewith. In addition, shape measurement data of the polishing pad 13 produced by the sensor 22 is sent from the measurement control unit 61 to the polishing control unit 60.

The dressing station ST2 constitutes an operating station where the polishing pad 13 is dressed, and the dresser 30 is able to be positioned below the polishing tool 10 moved to the dressing station ST2. The dresser 30 is configured from a rotating shaft 31 extending in the vertical direction (that is to say, in parallel with the rotating shaft 11 of the polishing tool 10) and a disc-shaped dressing plate 33 mounted by way of a thimble mechanism 32 to an upper part of the rotating shaft 31, the upper surface of the dressing plate 33 forming the dressing surface. The rotation control of the rotating shaft 31 of the dresser 30 is performed by way of a motor not shown in the diagram, the drive control of this motor being performed by a polishing control unit 60. The dresser 30 dresses the surface of the polishing pad 13 by polishing the surface of the polishing pad 13 mounted on the polishing tool 10 and, whenever a plurality of semiconductor wafers W are to be polished at the-later described polishing station ST3, the polishing tool 10 is moved to the dressing station ST2, after which the upper surface (dressing surface) of the rotated dressing plate 33 is brought into contact (pushed against) the polishing pad 13 of the rotated polishing tool 10 and the polishing pad 13 is dressed. In addition, apart from sharpening the polishing pad 13 as described above, the object of dressing the polishing pad 13 is to machine the shape of the polishing pad 13 to a predetermined shape and, accordingly, in addition being performed at a stage prior to a series of polishing steps for continuously polishing a plurality of semiconductor wafers W being started, this dressing is performed a plurality of times as an intermediate process in these polishing steps. Here, the distance between the rotating shaft 11 of the polishing tool 10 and the rotating shaft 31 of the dresser 30 can be accurately controlled by the polishing control unit 60 and, as will be described later, the polishing pad 13 can be finished to the desired shape in accordance with this distance. The distance between the rotating shaft 11 of the polishing tool 10 and the rotating shaft 31 of the dresser 30 is hereinafter referred to as the dressing position P (see FIG. 2).

The polishing station ST3 constitutes an operating station where the polishing tool 10 is employed to polish the surface of a semiconductor wafer W, the rotating support 40 being able to be positioned below the polishing tool 10 moved to the polishing station ST3. The rotating support 40 comprises a rotating shaft 41 extending in the vertical direction (that is to say, in parallel with the rotating shaft 11 of the polishing tool 10) and a rotating plate 42 fixed to an upper part of the rotating shaft 41, the rotating plate 42 being able to be rotated in the horizontal plane as a result of the rotation of the rotating shaft 41. A vacuum suction chuck mechanism not shown in the diagram is provided on the upper surface of the rotating plate 42, and the semiconductor wafer W can be vacuum-suctioned onto the rotating plate 42 by this vacuum chuck suction mechanism. Both the rotational control of the rotating shaft 41 and the oscillation control thereof are performed by way of motors not shown in the diagram, the drive control of these motors being executed by the polishing control unit 60. In addition, both the rotating support 40 and the polishing tool 10 are rotated with the polishing pad 13 having been brought into contact with the surface of the semiconductor wafer W from above, the polishing being performed on the entire surface of the semiconductor wafer W by an oscillating motion of the polishing tool 10 with respect to the rotating support 40 in the horizontal direction.

The process operation unit 70 is configured from a robot arm for conveying the semiconductor wafer W serving as the polishing target object and the polishing pad 13, and a slurry supply device (not shown in the diagram) for supplying a slurry to the surface of the semiconductor wafer W to be polished. In addition, the monitoring control unit 62 monitors the progress state of the (later-described) polishing steps of the semiconductor W performed by, for example, the polishing control unit 60, and executes an actuation control of the process operation unit 70 in accordance with the progress state of these polishing steps.

FIRST EXAMPLE

A first embodiment of the present invention will be hereinafter described. In this first embodiment, the steps for polishing the semiconductor wafer W by the polishing apparatus 1 of the configuration described above are performed in the sequence: (1) polishing pad 13 mounted on the polishing tool 10 by the process operation unit 70→(2) polishing pad 13 machined (dressed) by the dresser 30→(3) semiconductor wafer W carried in by the process operation unit 70 and mounted on the rotating support 40→(4) polishing pad 13 dressed by the dresser 30→(5) semiconductor wafer W machined by the polishing pad 13→(6) semiconductor wafer W removed from the rotating support 40 and carried out by the process operation unit 70→(3)→(4)→(5)→(6)→(3)→ . . . . While this polishing apparatus 1, as is described above, comprises a step for machining the polishing pad 13 provided in the polishing tool 10 (aforementioned Step (2)) prior to a series of polishing steps for continuously polishing the plurality of semiconductor wafers W by the polishing tool 10 being started, this polishing apparatus performs the step for machining the polishing pad 13 automatically, and this step will be hereinafter described in detail.

First, the possible polishing pad 13 shapes will be described. The shape of the polishing pad 13 has a significant effect on the polished state of the semiconductor wafer W that serves as the polishing target object, and three specific shape types, that is, a projecting conical shape in which the center portion projects downward from the perimeter portion (see FIG. 2(A)), a smooth shape in which the surface as a whole is flat (smooth) (see FIG. 2(B)), and a recessed conical shape in which the center portion depresses upward from the perimeter portion (see FIG. 2(C)) may be produced.

The shape of the polishing pad 13 is not able to be definitively determined by the distance between the rotating shaft 11 of the polishing tool 10 and the rotating shaft 31 of the dresser 30, that is to say, by the dressing position P. For this reason, the operator performs a shape adjustment based on trial and error. The characterizing feature of a polishing pad 13 dressed (polished) in a state in which the dressing position P constitutes a single particular predetermined value Pv as shown in FIG. 2(B) is that the shape of the polishing pad 13 does not change. Here, the dressing position P at which the shape change of the polishing pad 13 is a minimum is referred to as the "shape-keep position Pv" and, while in a state in which the dressing position P is larger than the shape-keep position Pv (P>Pv) the projecting shape is more pronounced as shown in FIG. 2(A), in a state in which the dressing position P is smaller than the shape-keep position Pv (P<Pv) the recessed shape is more pronounced as shown in FIG. 2(C). In other words, while the undulation shape speed of change of the polishing pad 13 is 0 at the shape-keep position Pv, at P>Pv a projected shape (+) is advance and at P<Pv a recessed shape (−) is advanced. A different value shape-keep position Pv is produced in accordance with characteristics such as hardness and shape of the polishing pad 13, and shape and mesh coarseness (denier) of the dresser 30 (dressing plate 33).

Figure 2:
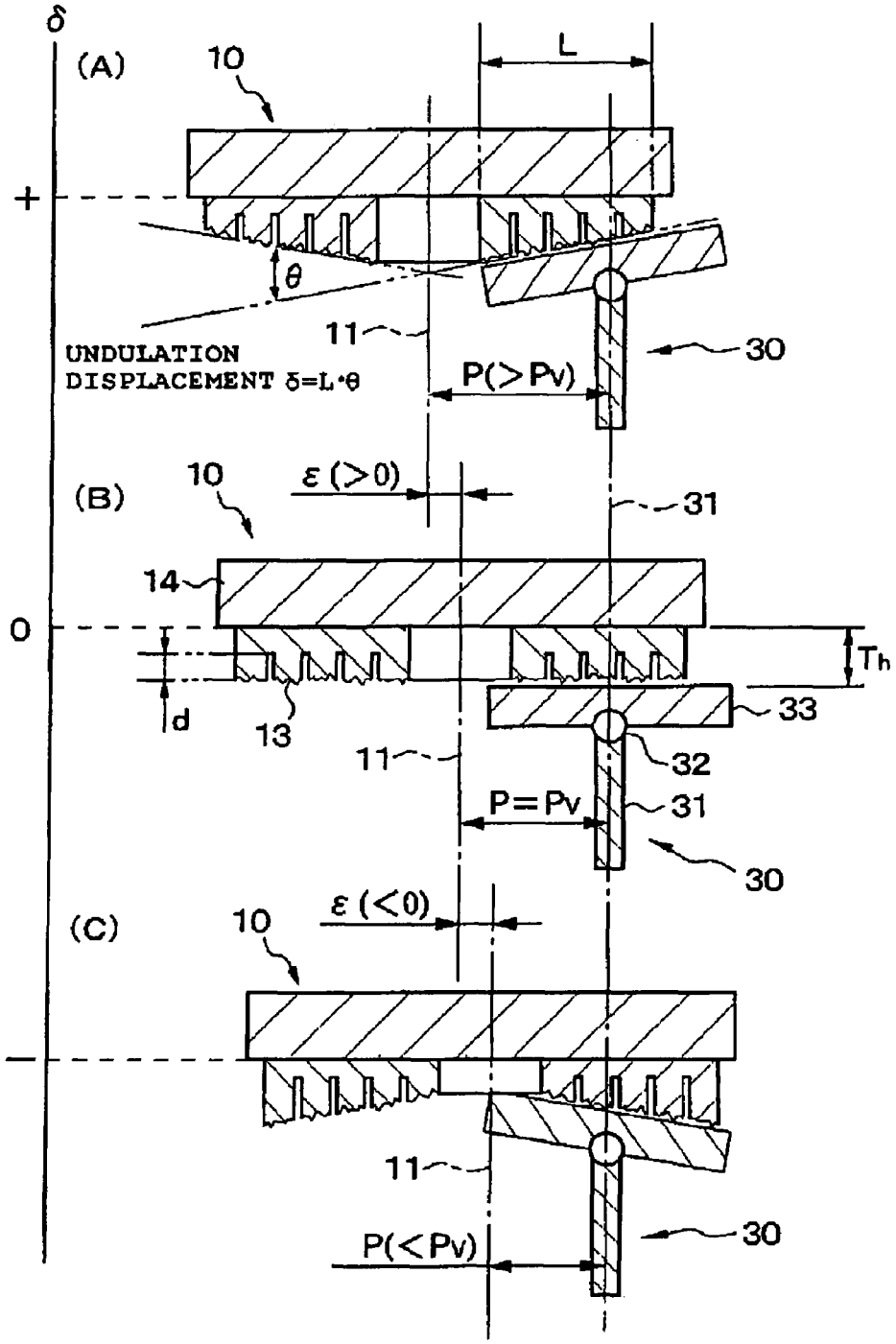
FIG. 2 is a diagram showing the relationship between dressing position and polishing pad shape, (A) shows a case where the dressing position is larger than the shape-keep position, (B) shows a case where the dressing position is equal to the shape-keep position, and (C) shows a case where the dressing position is smaller than the shape-keep position.

In addition, because the dressing position P can be expressed employing a shift amount ∈ from the shape-keep position Pv as:

$$P=Pv+\in \quad \text{(A1)},$$

the shape of the polishing pad 13 can be expressed as ∈=0 when the shape remains unchanged, as ∈>0 when a projecting conical shape is advanced, and as ∈<0 when a recessed conical shape is advance (see FIG. 2).

Here, the shape of the polishing pad 13 desired by the operator is referred to as the "target shape". The target shape denotes a predetermined surface undulation state, a predetermined break-in amount, or a predetermined groove depth range. In addition, expression of target shape necessitates stipulation of not only the value of an undulation displacement δ as shown in FIG. 2 for defining shape undulation as a numerical value, but also pad thickness th and groove depth d. The undulation displacement δ is a value obtained by multiplying a difference length L of the inner diameter and outer diameter of the polishing pad 13 by a supplementary angle θ of a conical vertical angle obtained by conical-shape approximation of the surface of the polishing pad 13. The supplementary angle θ is a very small value and, therefore, can be established in the aforementioned calculation by multiplication alone without need to employ a trigonometric function. Accordingly, the target shape is established in the same way as the undulation displacement δ target value, the undulation displacement δ value established correspondent to the target shape being hereinafter referred to in the description as the "target undulation displacement δT". The difference in target shape undulation can be discriminated on the basis of the polarity of the target undulation displacement δT and, therefore, the desired target shape can be stipulated by the sign of the target undulation displacement δT alone. More specifically, when δT>0 the stipulated target shape is a projecting conical shape, when δT=0 the stipulated target shape is a smooth shape, and when δT<0 the stipulated shape is a recessed conical shape. The pad thickness th is the average distance from the surface position of the polishing pad 13 to the surface of the polishing pad 13 mounted on the plate 14. The groove depth d is the average depth of these grooves.

In order to produce a particular target undulation displacement δT an undulation amount difference from an existing undulation displacement δ must be determined. The relationship between, the amount of change per unit time of the undulation displacement δ and the shift amount ∈ with respect to the previous shape-keep position Pv is essentially linear and, therefore, a sum of the shift amount ∈ and the dressing time is equivalent to the undulation amount to be machined. The polishing pad 13 can be machined to the target shape by properly controlling this shift amount ∈ and dressing time. However, determination of the shift amount ∈ necessitates that the shape-keep position Pv be already known. The actualization means thereof involves the dressing shape-keep position Pv in which, while acquiring data pertaining to the indicating the relationship between the dressing position P and shape change (undulation displacement change amount) of the polishing pad 13 through alternating repetition of polishing pad 13 dressing by the dresser 30 and polishing pad 13 shape measurement by pad shape measurement means 20, the dressing shape-keep position Pv can be machined to the target undulation displacement δT as the dressing shape-keep position Pv is estimated. Simultaneously, the dressing position for polishing a next semiconductor wafer W can be set to the previous shape-keep position Pv and the target undulation displacement δT can be constantly maintained.

While various methods for estimating the shape-keep position Pv have been considered, in this embodiment a method of inferring the shape-keep position Pv from the difference between the shape measurement value of an existing polishing pad 13 by the pad shape measurement instrument 20 and a previous shape measurement value is employed. This will be hereinafter described in detail.

As is described above, while the target shape of the polishing pad 13 may be any of either a projecting conical shape shown in FIG. 2(A), a smooth shape shown in FIG. 2(B) and a recessed conical shape shown in FIG. 2(C), if the polishing pad 13 is dressed with the dressing position P of the dresser 30 having been set to a position ($Pv+\in_0$) obtained by addition of a particular shift amount $\in_0$ to the shape-keep position Pv, when $\in_0=0$ the shape of the polishing pad 13 following dressing will be identical to the pre-machined shape, when $\in_0>0$ a conical shape projecting from the pre-machined shape will be formed, and when $\in_0<0$ a conical shape recessed from the pre-machined shape will be formed.

As is described above, while if the shape-keep position Pv of the dresser 30 is known the undulation shape change amount can be stipulated by the dresser 30 being moved a shift amount $\in_0$ only using the shape-keep position Pv as a criterion and a dressing being performed for a predetermined dressing time, because the shape-keep position Pv value is in reality unclear, the position of the shape-keep position Pv must first be roughly ascertained. For this purpose, firstly the dresser 30 is set to the dressing position P estimated as being the shape-keep position Pv (in reality, $P=Pv+\in$), after which dressing is performed for a predetermined dressing time Td, an undulation displacement δ speed of change $d\delta/dt$ ($=V_\delta$) of the polishing pad 13 generated by this dressing being calculated from the following equation:

$$V_\delta=d\delta/dt=E_\delta/Td \quad \text{(A2)}$$

$E_\delta$ denoting the undulation displacement difference before and after dressing.

Here, the dressing of the polishing pad 13 by the dresser 30 and the measurement of the undulation displacement δ of the polishing pad 13 before and after this dressing are automatically performed by a movement and rotational control of the polishing tool 10, a rotational control of the dresser 30, and an actuation control of the pad shape measurement instrument 20 executed by the polishing control unit 60 and the measurement control unit 61.

A proportional relationship is known to exist between the undulation displacement δ speed of change $V_\delta$ calculated by the above-noted equation (A2) and the shift amount ∈ from the shape-keep position Pv and, therefore, taking the proportional constant thereof as $K_\in$ and, employing $K_\in$ and ∈, $V_\delta$ can be expressed as:

$$V_\delta=K_\in\times\in \quad \text{(A3)}$$

The proportional constant $K_\in$ constitutes an experientially set (provisional) value and, in addition, as it is already known that the undulation displacement speed of change $V_\delta$ of the polishing pad 13 constitutes a value obtained (actually measured) in accordance with the shape measurement of the polishing pad 13, the value of the shift amount ∈ can be calculated from the shape-keep position Pv using these two values and transforming the above-noted equation (A3) as follows:

$$\in=V_\delta/K_\in \quad \text{(A3)'}.$$

Once the shift amount ∈ has been calculated, the shape-keep position Pv can be obtained by transforming the above-noted equation (A1) as follows:

$$Pv=P-\in \quad \text{(A1)'}$$

While an accurate shape-keep position Pv can be obtained from equation (A1)' provided the set (provisional) proportional constant $K_\in$ constitutes a dispersion-free value (in other words an accurate value), in reality the proportional constant $K_\in$ normally possesses dispersion and, as a result, the shape-keep position Pv obtained in this way is not necessarily accurate. Accordingly, the shape-keep position Pv obtained using this calculation is only ever regarded as a provisional value, and is hereinafter referred to as the "provisional shape-keep position Pv".

Once the provisional shape-keep position Pv' has been obtained in the manner described above, the (previously described) shift amount $\in_0$ that ensures the target undulation displacement δT generated by dressing for the dressing time Td is able to be produced is able to be obtained in accordance with the shape measurement of the polishing pad 13, and a dressing position (hereinafter referred to as a "control dressing position") Pc for shape measurement is able to be calculated from the equation:

$$Pc=Pv'+\in_0 \quad \text{(A4)}$$

established by replacing the above-noted equation (A1) with P=Pc, Pv=Pv' and $\in=\in_0$.

Here, an undulation displacement δ=δ(t) of the polishing pad 13 is expressed by integrating the two sides of the equation:

$$d\delta/dt=K_\in\times\in \quad \text{(A5)}$$

produced from the above-noted equation (A2) and equation (A3) as:

$$\delta(t)=K_\in\times\in\times t+C \quad \text{(A6)}$$

(C is a constant of integration) and, taking δ=δ(0) when t=0, C=δ(0) is established and equation (A6) can be rewritten as:

$$\delta(t)=K_\in\times\in\times t+\delta(0) \quad \text{(A7)}.$$

Assuming the undulation displacement δ of the polishing pad 13 can be produced at the control dressing position Pc ($=Pv'+\in_0$) obtained by adding the shift amount $\in_0$ to the provisional shape-keep position Pv' as the target undulation displacement δT by dressing performed for the dressing time Td, the equation:

$$\delta T=K_\in\times\in_o\times Td+\delta(0) \quad \text{(A8)}$$

can be obtained by inserting δ(t)=δT, $\in=\in_0$ and t=Td in equation (A7) and, by transforming equation (A8), the shift amount $\in_o$ can be established from the provisional shape-keep position Pv' as:

$$\in_o=(\delta T-\delta(0))/(K_\in\times Td) \quad \text{(A8)'}.$$

Because of the dispersion that the set proportional constant $K_\in$ possesses as described above, an accurate shape-keep position Pv cannot be determined by a single dressing measurement result alone. Accordingly, an additional dressing measurement is performed using the control dressing position Pc obtained in equation (A4) as the new dressing position P whereupon, employing the plurality of dressing measurement results (dressing measurement results for a plurality of dressing positions P) obtained in this way, the most probable value, as produced by statistical processing, can be determined as the true shape-keep position Pv.

An example method of statistical processing for determining the shape-keep position Pv is based on an assumption of linear recurrence in the relationship between the plurality of dressing positions P obtained by the plurality of dressing measurements and $V_\delta$(=dδ/dt) and calculation of a recurrence coefficient thereof, and then obtaining the intercept of the dressing position P at which $V_\delta$ is approximately zero and determining this intercept as the shape-keep position Pv. Otherwise, an average value of a plurality of obtained shapekeep positions Pv can be obtained and used to determine the actual shape-keep position Pv. Furthermore, the shape-keep position Pv may be obtained with more probability based on a method that combines these two methods. The processing for determining the shape-keep position Pv using these methods involves the polishing pad 13 dressing conditions being set at a stage prior to a series of polishing steps, the shape of the polishing pad 13 being able to be maintained to the predetermined undulation displacement by dressing the polishing pad 13 at the shape-keep position Pv set on the basis thereof.

Figure 3:
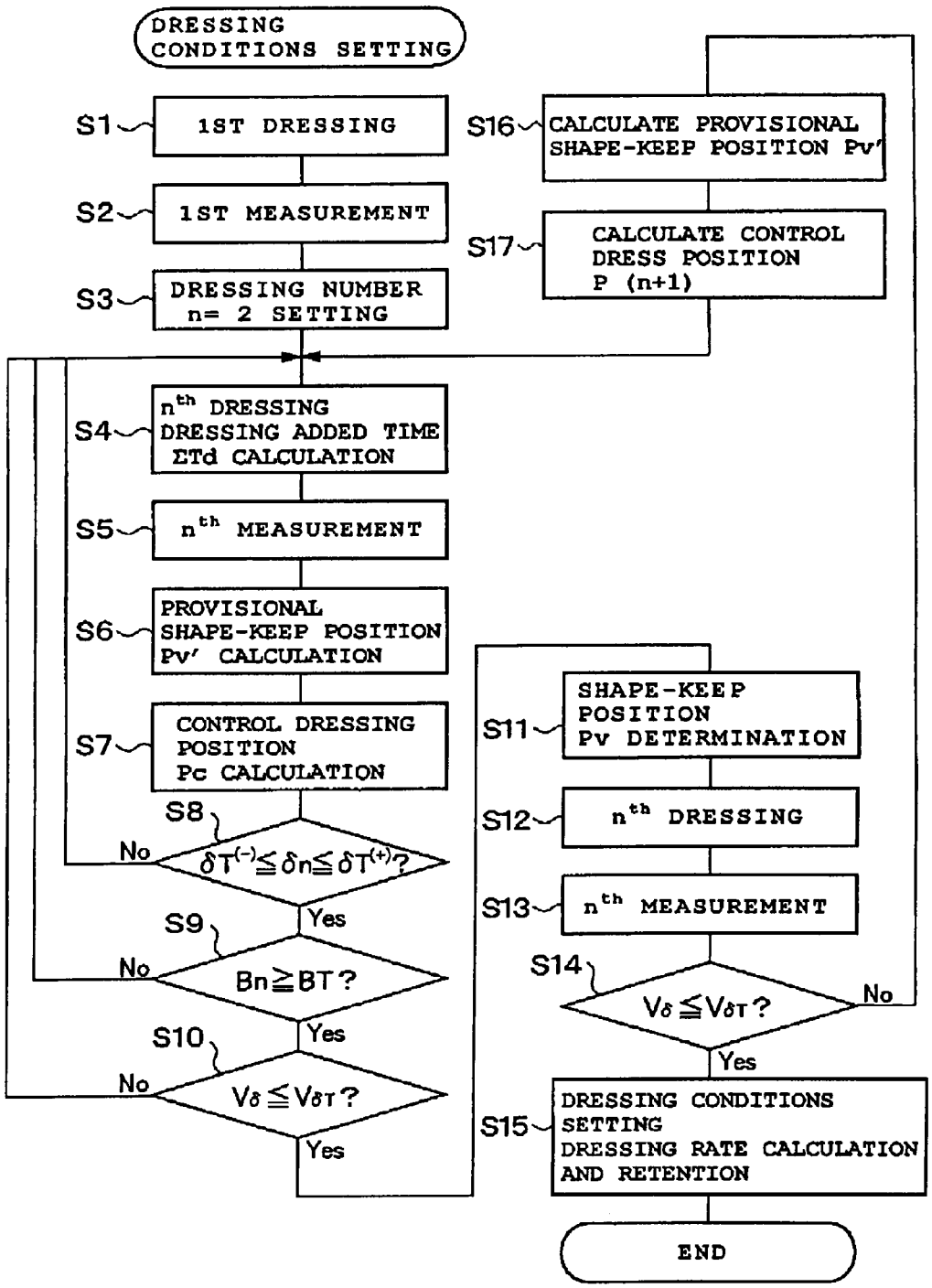
FIG. 3 is a flow chart of the sequence for setting the polishing apparatus dressing conditions.

The sequence in which the aforementioned dressing conditions are set will be hereinafter described in detail with reference to the flow chart of FIG. 3. Here, the distance between the rotating shaft 11 of the polishing pad 13 and the rotating shaft 31 of the dresser 30, that is to say, the dressing position P, is expressed as P(n). The subscript (n) of this P(n) denotes the number of times that the polishing pad 13 is dressed and the number of times the shape thereof is measured in the step for machining the polishing pad 13.

The sequence for setting the dressing conditions begins with a 1st dressing performed with the polishing tool 10 (that is to say, the polishing pad 13) moved to the dressing station ST2 (Step S1). The number of repetitions n of this 1st dressing is taken as n=1, and the dressing position P(1) at this time is an experientially produced average shape-keep position or an already pre-stored shape-keep position. Here, this 1st the dressing time of this dressing is taken as for a $Td=T_1$.

Upon completion of Step S1, the polishing tool 10 is moved to the pad shape measurement station ST1 where the undulation displacement δ, thickness th and groove depth de of the polishing pad 13 are measured by the pad shape measurement instrument 20 (Step S2). Here, the undulation displacement δ shown in FIG. 2 is a value obtained by multiplying a difference length L between the outer diameter and inner diameter of the polishing pad 13 with a supplementary angle θ of a conical vertical angle obtained by conical approximation of the surface of the polishing pad 13. In addition, as shown in FIG. 2, the pad thickness th constitutes a distance from the average surface position of the polishing pad 13 to the surface of the polishing pad 13 mounted on the polishing tool 10. In addition, the groove depth de of the polishing pad 13 is defined as an average value of the depth d of all grooves of the polishing pad 13 (see FIG. 2). Upon completion of the 1st dressing, the undulation displacement of the measured polishing pad 13 is taken as $\delta_1$, the thickness of the polishing pad 13 is taken as $th_1$, and the groove thickness of the polishing pad 13 is taken as $de_1$.

Upon completion of Step S2, the number of repetitions n is taken as n=2 and is set as an initial-state value (Step S3). Upon completion of Step S3, the dressing is performed n(=2) times. The dressing position at this time is the same as that at the 1st dressing position P(1). In addition, taking the dressing time as $Td=T_2$, a sum dressing time $\Sigma Td=T_1FT_2$ is calculated (Step S4). Here, because the dressing time is fundamentally more easily understood as a fixed value, $Td=T_1=T_2= \ldots =Tn$. Accordingly, the sum dressing time is obtained as ΣTd=n×Td.

Upon completion of Step S4, the polishing tool 10 is moved to the pad shape measurement station ST1 and the undulation displacement δ, thickness th and groove depth de of the polishing pad 13 are measured by the pad shape measurement instrument 20 (Step S5). Following completion of this $n(=2)^{th}$ dressing, the undulation displacement of the measured polishing pad 13 is taken as $\delta_2$, the thickness of the polishing pad 13 is taken as $th_2$, and the groove thickness of the polishing pad 13 is taken as $de_2$.

Upon completion of Step S5, the provisional shape-keep position Pv' of the dresser 30 is calculated (Step S6). For this purpose, a change amount $E_{\delta n}=\delta_n-\delta_{n-1}$ of the undulation displacement of the polishing pad 13 is firstly obtained. Here, n=2 and, accordingly, $E_{\delta 2}=\delta_2-\delta_1$. Once $E_{\delta 2}$ has been obtained, the undulation displacement δ speed of change $V_\delta$ can be obtained from this $E_{\delta 2}$ and the dressing time Td employing the above-noted equation:

$$V_\delta=d\delta/dt=E_\delta/Td \quad \text{(A2)}$$

and the shift amount ∈ from the shape-keep position Pv can be obtained from the above-noted equation:

$$\in=V_\delta/K_\in \quad \text{(A3)'.}$$

Once the shift amount ∈ has been obtained in this way, the provisional shape-keep position Pv' can be obtained from the above-noted equation (A1)' using the equation:

$$Pv'=P(n)-\in \quad (1).$$

Accordingly, for example, when $P_1$=100 (mm), $P_2$=100 (mm), Td=1(min), $K_\delta$=10(μm/min)/(mm), $\delta_1$=0 (μm) and $\delta_2$=5(μm), the shift amount ∈ is established from $E_{\delta 2}=\delta_2-\delta_1$ as ∈=((5−0)/1)10=0.5 (mm). Because, at this time, the shift amount ∈ has a positive polarity, the value of the provisional shape-keep position Pv' is smaller than the dressing position $P_2$ by an amount of 0.5 (mm). Accordingly, the provisional shape-keep position Pv' in this (n=2) example is established as:

$$Pv'=P_2-\in=100-0.5=99.5 \text{ (mm).}$$

Upon completion of Step S6, the control dressing position Pc is calculated with n=n+1 (Step S7). Replacing Pc→P(n+1) in the above-noted equation (A4), the control dressing position Pc can be expressed as:

$$P(n+1)=Pv'+\in_0 \quad (2).$$

In addition, from the above-noted two equations (1) and (2) it can also be expressed as:

$$P(n+1)=P(n)-\in+\in_0 \quad (3).$$

Here, n=2. In addition, the shift amount $\in_0$ from the above-noted equation is:

$$\in_0=(\delta T-\delta(0))/(K_\in\times Td) \quad \text{(A8)'}$$

and, for example, when $\delta(0)=\delta_2$=5 (μm), because δT=−1 (μm) (the value of the target undulation displacement δT is preinput into a control unit, for example, the polishing control unit 60 of the polishing apparatus 1), a shift amount $\in_0$ from the provisional shape-keep position Pv' of:

$$\in_0=(-1-5)/(10\times 1)=-0.6 \text{ (mm)}$$

is established. In addition, the control dressing position P(n+1) (here, n+1=3) is established from the above-noted equation (3) as:

$$P_3=99.5+(-0.6)=98.9 \text{ (mm).}$$

Once the control dressing position Pc has been obtained in this way, the dressing position P of the dresser 30 is set to the control dressing position Pc and the polishing pad 13 is dressed for the dressing time Td. Thereafter, the thus-obtained undulation displacement δ speed of change $V_\delta(=d\delta/dt)$ of the polishing pad 13 is calculated and stored as dressing position P and $V_\delta$ relationship data, and steps from Step S4 to Step S7 are repeated employing the newly obtained provisional shape-keep position Pv' and the next control dressing position Pc values. In addition, although not indicated in FIG. 3, the provisional shape-keep position Pv' at this time is stored as data. In the course of this process, the control dressing position Pc is converged to a particular value, and the thus-converged value serves as the actual shape-keep position Pv. However, in true dressing measurement, a control dressing position Pc not converged to a particular value is sometimes exhibited because of measurement error and so on and the dispersion present in the proportional constant $K_\delta$. This implies that the provisional proportional constant $K_\delta$ is inappropriate and, in this case, the control dressing position Pc can be converged by multiplying the shift amount ∈ from the measured shape-keep position Pv and the shift amount $\in_0$ from the provisional shape-keep position Pv' by the correction coefficients $H_1$, $H_2$ as in equations (4) and (5) noted below:

$$\in'=H_1\times\in \quad (4)$$

$$\in'=H_2\times\in_0 \quad (5).$$

Merging equations (4) and (5) with the above-noted equation (3), the control dressing position P(n+1) may be expressed as:

$$P(n+1)=P(n)-\in'+\in_0' \quad (6).$$

Here, each of the aforementioned correction coefficients $H_1$, $H_2$ is preferably no more than 1.

Upon completion of Step S7, judgments as to whether or not the steps from Step S4 to Step S7 are to be repeated are made (Steps S8 to Step S10). For this purpose, first, a judgement as to whether or not the undulation displacement δ is within a predetermined permissible range with respect to the target undulation displacement δT is made (Step S8). More specifically, taking the minimum limit value of the permissible range of the target undulation displacement δT as $\delta T^{(-)}$ and the maximum limit value as $\delta T^{(+)}$, a judgment of whether or not δ(n) satisfies the equation:

$$\delta T^{(-)}\leqq\delta(n)\leqq\delta T^{(+)} \quad (7)$$

is made. Here, for example, when δT is δT=−1(μm) as described above, the minimum limit value $\delta T^{(-)}$ and maximum limit value $\delta T^{(+)}$ for the target undulation displacement δT are $\delta T^{(-)}=-4$(μm), $\delta T^{(+)}=2$ (μm) respectively taking the permissible range of the target undulation displacement δT as δT±3(μm) and, therefore, a judgment of whether or not the measured undulation displacement δ(n) satisfies the equation:

$$-4\leqq\delta(n)\leqq 2$$

at this time is made. Thereafter, if the measured undulation displacement δ(n) satisfies (judgment is Yes) the above-noted equation (7) the process advances to the next Step S9 and, if it does not satisfy (judgment is No) equation (7), the process returns to Step S4. In the example noted above, because the undulation displacement of the measured polishing pad 13 is $\delta_2=5$(μm), the process returns to Step S4 and the polishing pad 13 dressing is continued. The dressing position P of the dresser 30 set at this time constitutes, as described above, a control dressing position P(n+1) obtained from the above-noted equation (6). That is to say, if both the above-noted correction coefficients $H_1$ and $H_2$ are 1, the n=3$^{rd}$ dressing position P of Step S4 is the $P_3$=98.9 (mm) obtained in the manner described above.

When the judgment in Step S8 is Yes, a judgment of whether or not a next shave amount Bn of the polishing pad 13 is equal to or more than a target shave amount ET is made (Step S9). Here, the shave amount Bn of the polishing pad 13 refers to the amount scraped off the polishing pad 13. A judgment of whether or not the shave amount Bn of the polishing pad 13 is equal to or greater than the target shave amount is made because, when the polishing pad 13 is polished, a certain amount of the surface layer of the polishing pad 13 must be scraped off to afford compatibility between the polishing pad 13 and the semiconductor wafer W. Because the n$^{th}$ shave amount Bn is expressed as the difference between the thickness thn of the polishing pad 13 at the n$^{th}$ measurement and the thickness $th_1$ of the polishing pad 13 at the 1st measurement as:

$$Bn=thn-th_1 \quad (8),$$

when the n$^{th}$ shave amount Bn of the polishing pad 13 satisfies (judgment is Yes) the equation:

$$Bn\geqq BT \quad (9),$$

the shave amount Bn of the polishing tool 10 is assumed to be at least the target shave amount BT and the process advances to Step S10 and, if it does not satisfy equation (9) (judgment is No), the shave amount Bn of the polishing pad 13 is assumed to be less than the target shave amount BT and the process returns to Step S4.

When the judgment in Step S9 is Yes, a judgment of whether or not the undulation displacement speed of change $V_\delta(=d\delta/dt=E_{\delta n}/Tn)$ of the polishing pad 13 is equal to or less than the target speed of change $V_{\delta T}$ is made (Step S10). More specifically, a judgment of whether or not the $V_\delta$ obtained employing the displacement amount $E_{\delta n}=\delta_n-\delta_{n-1}$ of the undulation displacement of the polishing pad 13 obtained in Step S6 satisfies the following equation:

$$V_\delta\leqq V_{\delta T} \quad (10)$$

is made. Here, the $V_\delta$ that satisfies equation (10) serves as an indicator that the existing dressing position P(n) is close to the true dressing position Pv. Thereafter, when $V_\delta$ satisfies (judgment is Yes) equation (10), the process advances to the next Step S11, and if it does not satisfy (judgment is No) equation (10), the process returns to Step S4.

While judgments as to whether or not the steps from Step S4 to Step S7 are to be repeated is made on the basis of the three judgment criteria of Step S8 to Step S10 in this way, the judgment criteria need not be restricted to the three criteria described above. For example, if all three judgment criteria for from Step S8 to Step S10 cannot be cleared and only the number of repetitions n is increased, the upper limit value of n may be prestipulated and, provided at least one criterion can be cleared, the process can advance to the next Step S11.

In Step S11 the (true) shape-keep position Pv of the dresser 30 is determined. The shape-keep position Pv is determined at a stage when a plurality of measurement data (plurality of control dressing positions Pc) have been acquired as described above and the judgment criteria of Steps S8 to Step S10 have been satisfied. The method for the calculation thereof is performed in accordance with the method described above. To determine the shape-keep position Pv, the original data selection criteria employed for this determination may be provided. For example, data at which the undulation displacement speed of change $V_\delta$ of the polishing pad 13 is a particular criterion value or below alone may be selected, or data within a particular range of the target undulation displacement δT alone may be selected.

Upon completion of Step S11, the polishing pad 13 is dressed at the shape-keep position Pv obtained in Step S11 (Step S12). Upon completion of Step S12, the polishing tool 10 is moved to the pad shape measurement station ST1, and the undulation displacement δ(n) of the polishing pad 13 and thickness thn and groove depth den of the polishing pad 13 are calculated (Step S13).

Upon completion of Step S13, a judgment of whether or not Steps S4 to S13 is to be repeated is made (Step S14). More specifically, the undulation displacement change amount $E_{\delta n}=\delta_n-\delta_{n-1}$ of the polishing pad 13 is obtained to calculated the speed of change $V_\delta(=d\delta/dt=E_{\delta n}/Tn)$, and a judgment of whether or not the speed of change $V_\delta$ is equal to or less than the target speed of change $V_{\delta T}$, that is to say, whether or not $V_\delta$ satisfies the following equation:

$$V_\delta \leqq V_{\delta T} \tag{11}$$

is made. In this judgment if $V_\delta$ satisfies (judgment is Yes) the above-noted equation (11) the process advances to Step S15 and, if it fails to satisfy (judgment is No) equation (11), the process returns to Step S16. In the judgment made in the aforementioned Step S14, the target speed of change $V_{\delta T}$ value may be altered to that of Step S10.

In Step S15, the shape-keep position Pv determined in Step S11 is set (or updated) as a polishing apparatus 1 dressing condition. In addition, a dressing rate Rd is calculated from the equation:

$$Rd=Bn/\Sigma Td \tag{12}.$$

This dressing rate Rd is stored as an apparatus constant of the polishing apparatus 1 and is employed as a parameter in subsequent polishing steps for evaluating the need for the dresser 30 to be replaced. The step for setting the dressing conditions is completed in Step S15.

On the other hand, in Step S16 and the subsequent Step S17, processings identical to the processings of Step S6 and Step S7 described above are performed, after which the process returns to Step S4. A retry-count may be carried out and, when this retry count exceeds a stipulated number, an error will be judged to have occurred and the dressing condition setting sequence will be forcibly terminated.

While the dressing conditions is thus completed, in this polishing apparatus 1, information pertaining to the end mode of the above-described dressing condition setting sequence, that is to say, whether the sequence has ended normally (Step S15), or proceeded to a retry step (Step S16), or has ended in error as described above is sent to the monitoring control unit 62. The monitoring control unit 62 actuates the process operation unit 70 normally upon receipt of information to the effect that the dressing condition setting sequence has ended normally and, upon receipt of information to the effect that the sequence has proceeded to the retry step or that the process has ended in error, it actuates the process operation unit 70 to perform processing compliant with the particulars of the error. For example, upon receipt of information to the effect that the dressing conditions setting sequence has proceeded to the retry step, because a step for machining the polishing pad 13 and, in turn, a step for polishing the semiconductor wafer W are delayed, a command must be issued to the process operation unit 70 to stop a new semiconductor wafer W being conveyed to the polishing apparatus 1.

Subsequent to the steps described above being implemented by polishing apparatus 1, the polishing pad 13 can be machined to the target undulation displacement δT and the target undulation displacement δT can be maintained. Hence, preparation for polishing steps of the semiconductor wafer W is completed.

Upon completion of the preparation for the polishing steps, the process operation unit 70 is operated to convey the semiconductor wafer W into the polishing station ST3 of the polishing apparatus 1 where it is held on the upper surface of the rotating plate 42. The polishing tool 10 is moved to the polishing station ST3 and, upon positioning thereof above the semiconductor wafer W, both the polishing tool 10 and rotating support 40 are rotated. Once the rotation of both the polishing tool 10 and the rotating support 40 is started, the polishing tool 10 is lowered and the polishing pad 13 is brought into contact with the semiconductor wafer W. As a result, a relative movement between the semiconductor wafer W and the polishing pad 13 is generated and the surface of the semiconductor wafer W is polished. Furthermore, the polishing tool 10 is oscillatingly moved within the horizontal plane at this time to ensure the entire surface of the semiconductor wafer W is uniformly polished. In addition, as the semiconductor wafer W is being polished, slurry is supplied to the contact surface between the semiconductor wafer W and the polishing pad 13 by a slurry supply device not shown in the diagram (part of the process operation unit 70 as described above) which, in addition to affording an improved polishing effect, removes the shavings therefrom.

Figure 4:
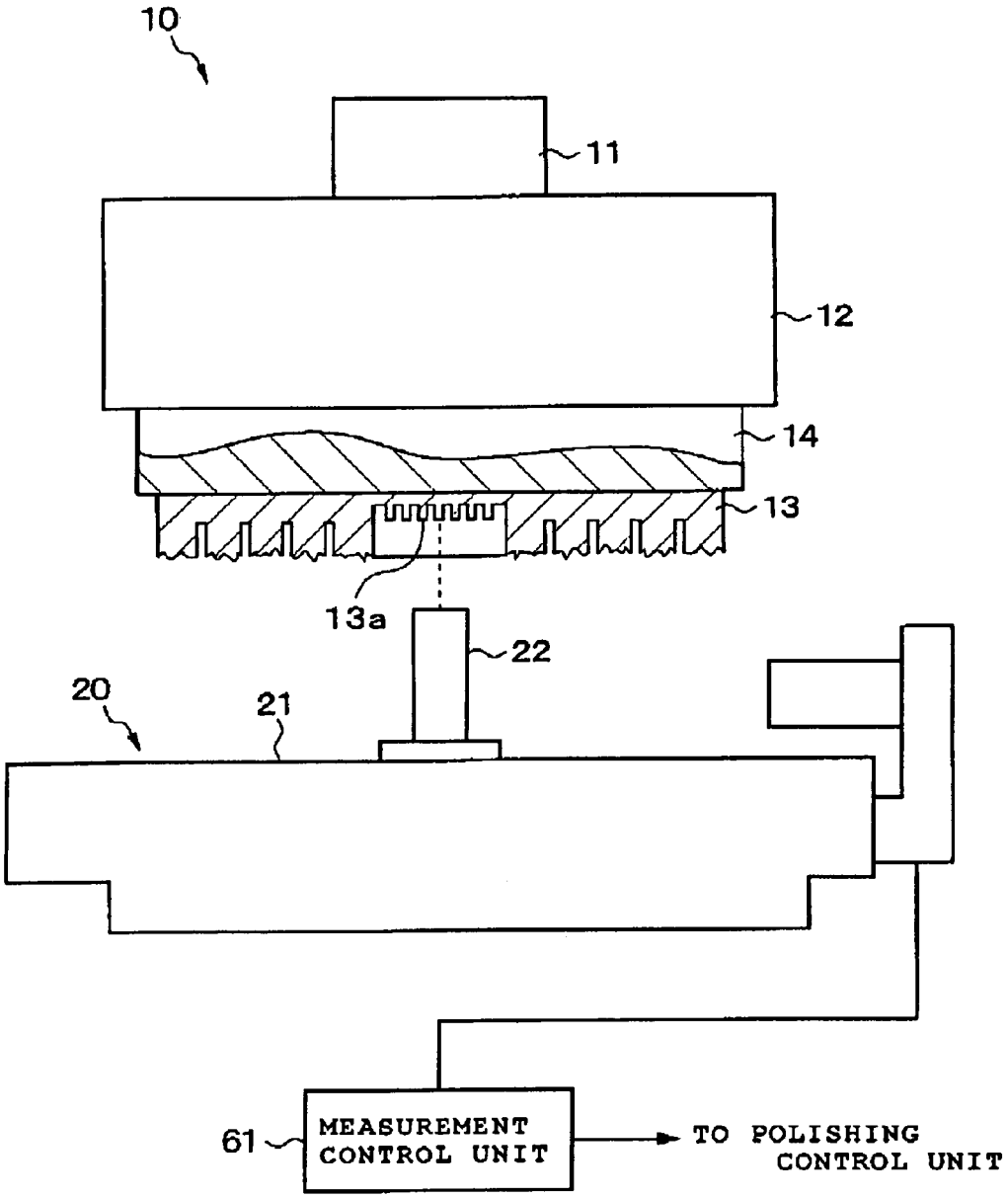
FIG. 4 is a diagram showing a configuration of a pad type detection means for detecting polishing pad type.

Incidentally, the polishing conditions set in the steps for polishing the semiconductor wafer W as described above such as, for example, the various conditions including the rotational speeds of each of the polishing tool 10 and the rotating support 40, the relative oscillating speed and oscillating width of the polishing tool 10, the magnitude of the pressure force and polishing time of the polishing tool 10 on the semiconductor wafer W along with the slurry supply flow rate and supply amount and so on must be individually set in accordance with the semiconductor wafer W type (film type) serving as the polishing target object and the polishing pad 13 type being used and so on. Here, the polishing pad 13 type employed for the polishing of the semiconductor wafer W is determined in accordance with the film type of the semiconductor wafer W to be polished and, therefore, the polishing pad 13 type can be determined once the semiconductor wafer W type (film type) is determined. Accordingly, if the polishing pad 13 type is known the semiconductor wafer W type (film type) serving as the polishing target object can also be determined and, as a natural outcome thereof, the required polishing conditions can also be determined. In the polishing apparatus 1 of this embodiment, as shown in FIG. 4, pad type discrimination protrusions 13*a* comprising a (characteristic) undulation shape (concentric circular grooves or the like) correspondent to the polishing pad 13 type is provided in the centre portion of the polishing pad 13 and, by measurement of the shape of the undulation portion (pad type discrimination protrusions 13*a*) of the polishing pad 13 mounted on the polishing tool 10 employing the pad shape measurement unit 20 provided in the pad shape measurement station ST1 of the polishing apparatus 1, the polishing pad 13 type can be detected. The thus detected information is sent by way of the measurement control unit 61 to the polishing control unit 60. Various polishing condition data established for each polishing pad 13 type are prestored in a storage unit not shown in the diagram of the polishing control unit 60, the polishing control unit 60 setting the required polishing conditions on the basis of information produced by the measurement control unit 61.

Here, the detection of the aforementioned polishing pad 13 type is not necessarily limited to an assembly based on pad type discrimination protrusions 13*a* formed in the polishing pad 13 and the pad shape measurement unit 20 for measuring the shape thereof as illustrated in this embodiment and, accordingly, other means may be employed. For example, replacing the undulation shape (pad type discrimination protrusions 13*a*) as described above provided in the polishing pad 13, the polishing pad 13 type may be detected by provision of an identifier (for example, concentric circular strip) possessing a characteristic reflectance correspondent to the polishing pad 13 type, and detection of the reflectance of this identifier by, for example, an optical pick-up or the like.

In addition, when the groove depth de of the polishing pad 13 is detected as having reached a preset depth $de_0$ on the basis of groove depth de information measured whenever polishing pad 13 dressing for a predetermined time Td has been completed, the polishing control unit 60 assumes that the usage lifespan of the polishing pad 13 has expired and executes an operation control of the process operation unit 70 for the polishing pad 13 to be replaced. After the polishing pad 13 is replaced, a step for machining the new polishing pad 13 is executed in accordance with the sequence described above.

In addition, once completion of the polishing of a semiconductor wafer W has been detected, the polishing control unit 60 issues a command to the process operation unit 70 for the polished semiconductor wafer W to be carried out of the polishing apparatus 1 and for the semiconductor wafer W serving as the new polishing target object to be carried into the polishing apparatus 1. The semiconductor wafer W polishing described above is repeated. When the new semiconductor waver W serving as the polishing target object is carried in, prior to the start of the semiconductor wafer W polishing, the polishing pad 13 is dressed (sharpened). It is preferable at this time for the dressing time to be inversely proportional to the calculated dresser 30 dressing rate Rd.

In this way, the polishing apparatus 1 pertaining to the present invention comprises pad machining control means (equivalent to the polishing control unit 60 of this embodiment) for, while acquiring data indicating the relationship between the dressing position P defined by the distance between the rotating shaft 11 of the polishing pad 13 and the rotating shaft 31 of the dresser 30 and shape change of the polishing pad 13 based on input of the target shape of the polishing pad 13 and alternating repetition of polishing pad 13 dressing by the dresser 30 and polishing pad 13 shape measurement by the pad shape measurement unit 20 at a stage prior to initiation of a series of polishing steps for continuously polishing a plurality of polishing target objects (semiconductor wafers W) by the polishing tool 10, machining the polishing pad 13 to the target shape while controlling the dressing position P, and dressing position setting means (equivalent to the polishing control unit 60 of this embodiment) for setting the dressing position P during the polishing steps based on a processing result of the aforementioned data.

By virtue of the polishing apparatus 1 pertaining to the present invention having the aforementioned configuration the step for machining the polishing pad 13 to the predetermined target shape is automatically performed and, unlike in the prior art, because of the absence of a step for finishing to the target shape involving the operator dressing the polishing pad 13 on the basis of trial and error, the shape adjustment of the polishing pad can be carried out in a short time and the throughput of the polishing steps as a whole can be improved.

In addition, dressing position setting means of the polishing apparatus 1, based on data illustrating the relationship between the dressing position P and polishing pad 13 shape change, obtains the dressing position P at which the undulation displacement δ speed of change $V_\delta$ ($=d_\delta/dt$) of the polishing pad 13 is approximately zero, and uses the thus-obtained dressing position P as a criterion to set the dressing position (equivalent to the shape-keep position Pv of, this embodiment) at which the polishing pad 13 shape change is minimized.

In addition, this polishing apparatus 1 comprises pad type detection means (equivalent to pad type discriminating protrusions 13*a* of the polishing pad 13 and pad shape measurement instrument 20 of this embodiment) for detecting the polishing pad 13 type mounted on the polishing tool 10, and polishing condition setting means (equivalent to the polishing control unit 60 of this embodiment) for setting the polishing conditions of the semiconductor wafer W serving as the polishing target object in accordance with the polishing pad 13 type detected by pad type detection means, the polishing pad 13 type being automatically discriminated, and the conditions (for example, various conditions such as the relative movement speed and polishing time and so on of the polishing pad 13 with respect to the polishing target object during polishing) for polishing the polishing target object (semiconductor wafer W) being automatically set. Unlike the prior art, because of the absence in this polishing apparatus 1 of a step in which the polishing pad 13 type is discriminated by an operator and the polishing conditions set in accordance therewith, the throughput of the polishing steps as a whole can be improved. A configuration such as this in which, by virtue of comprising pad type detection means and polishing condition setting means for setting the conditions for polishing the polishing target object in accordance with the type of polishing pad detected by pad type detection means, the polishing pad type is automatically discriminated and the polishing target object polishing conditions automatically set in response thereto, is able to have application in polishing apparatuses of a different configuration to the polishing apparatus 1 outlined in this embodiment.

In addition, because this polishing apparatus 1 comprises process operation means (equivalent to process operation unit 70 in this embodiment) for performing process operations such as conveyance and so on of the polishing target object (semiconductor wafer W) and the polishing pad 13 and monitoring control means (equivalent to the monitoring control unit 62 of this embodiment) for monitoring the progress state of the polishing steps and executing an actuation control of process operation means in accordance with this progress state of the polishing steps and adjustments can be automatically made to the progress of the process operations during the time that is taken to set the dressing conditions and when delays occurs in the polishing steps themselves, the downtime of the polishing apparatus 1 can be reduced and, in turn, a reduction in costs can be achieved.

SECOND EXAMPLE

A second embodiment of the present invention will be hereinafter described. The polishing apparatus 1 of the configuration shown in FIG. 1 is employed in this second embodiment as well, and the steps for polishing the semiconductor wafer W by this polishing apparatus 1 are performed in the sequence: (1) polishing pad 13 mounted on the polishing tool 10 by the process operation unit 70→(2) polishing pad 13 machined (dressed) by the dresser 30→(3) semiconductor wafer W carried in by the process operation unit 70 and mounted on the rotating support 40→(4) polishing pad 13 dressed by the dresser 30→(5) semiconductor wafer W polished by the polishing pad 13→(6) semiconductor wafer W removed from the rotating support 40 and carried out by the process operation unit 70→(3)→(4)→(5)→(6)→(3)→ . . . .

While this polishing apparatus 1, as described above, comprises a step for dressing the polishing pad 13 provided in the polishing tool 10 (aforementioned Step (4)) as an intermediate process in a series of polishing steps for continuously polishing the plurality of semiconductor wafers W by the polishing tool 10, in this polishing apparatus 1*a* step for shape adjusting (machining) the polishing pad 13 that utilizes the step for dressing the polishing pad 13 is automatically performed as an intermediate process in the polishing steps, and this step will be hereinafter described in detail.

The polishing pad 13 is able to be produced as three shape types, that is, a projecting conical shape in which the center portion projects downward from the perimeter portion (see FIG. 2(A)), a smooth shape in which the surface as a whole is flat (smooth) (see FIG. 2(B)), and a recessed conical shape in which the center portion depresses upward from the perimeter portion (see FIG. 2(C)) and, as these are identical to the shape types of the first embodiment, an explanation thereof has been omitted.

In the polishing apparatus 1 pertaining to the second embodiment, first the shape-keep position Pv is detected by some method such as trial and error and the thus-obtained value set as an apparatus constant which, when the polishing pad 13 is dressed, is used for dressing the shape-keep position Pv. By virtue of this and, in addition, as a result of the dressing being performed not only at a stage prior to commencement of the polishing steps but also following the start of the polishing steps, every time the polishing of one or a plurality of semiconductor wafers W has been completed, the shape of the polishing 13 is able to be retained to the target shape. However, even if the dressing position P of the dresser 30 is set to the shape-keep position Pv prior to the start of the polishing steps, because of characteristic changes in the dresser 30 and errors in the set shape-keep position Pv that occur during the process in which the polishing target objects (semiconductor wafers W) are polished one after the other in accordance with the progress of the polishing steps, the preestablished target shape of the polishing pad 13 cannot be retained. In other words, this is liable to occur when the true shape-keep position Pv of the dresser 30 cannot be accurately set and when fluctuations in the true shape-keep position Pv of the dresser 30 occur. In order to specifically distinguish the true shape-keep position Pv of the dresser 30 this is hereinafter referred to as the "true shape-keep position Pvr".

Figure 5:
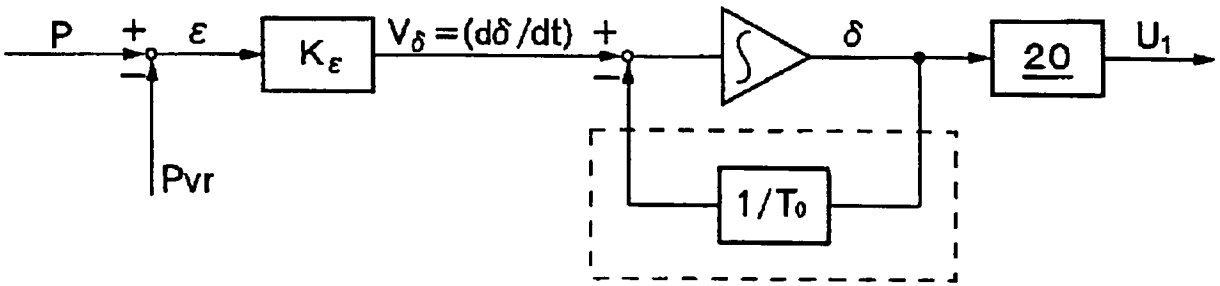
FIG. 5 to FIG. 8 are block diagrams illustrating dressing position control.

While in this polishing apparatus 1 the undulation displacement δ of the polishing pad 13 is measured by the pad shape measurement unit 20 as described later, taking this undulation displacement δ as a result obtained by integration of the undulation displacement δ speed of change $V_\delta$ with a predetermined sample time t, the relational equation:

$$V_\delta = d\delta/dt \tag{2}$$

is established. On the other hand, since there is known to be proportional relationship between the undulation displacement δ speed of change $V_\delta$ and the aforementioned shift amount ∈, taking the proportional constant thereof as $K_\in$, the relationship:

$$V_\delta = K_\in \times \in \tag{3}$$

is established. FIG. 5, which shows the relationship descried above, is a block diagram showing the relationship between the true shape-keep position Pvr, the dressing position P at the time of dressing, and the undulation displacement δ of the polishing pad 13 measured by the pad shape measurement unit 20. In FIG. 5, the value of the undulation displacement δ measured by the pad shape measurement unit 20 is indicated as $U_1$. In addition, while a feedback of $1/T_0$ times the undulation displacement δ is shown in FIG. 5, this denotes the saturation characteristic of the undulation displacement δ, and the actual dressing characteristics of the polishing pad 13 and the dresser 30 possesses this saturation characteristic at the very least. Equations (1), (2) and (3) constitute equations in which this feedback is ignored. However, the present invention possesses an adaptability unrelated to the existence of this saturation characteristic. $T_0$ denotes a constant when saturation has occurred.

Figure 6:
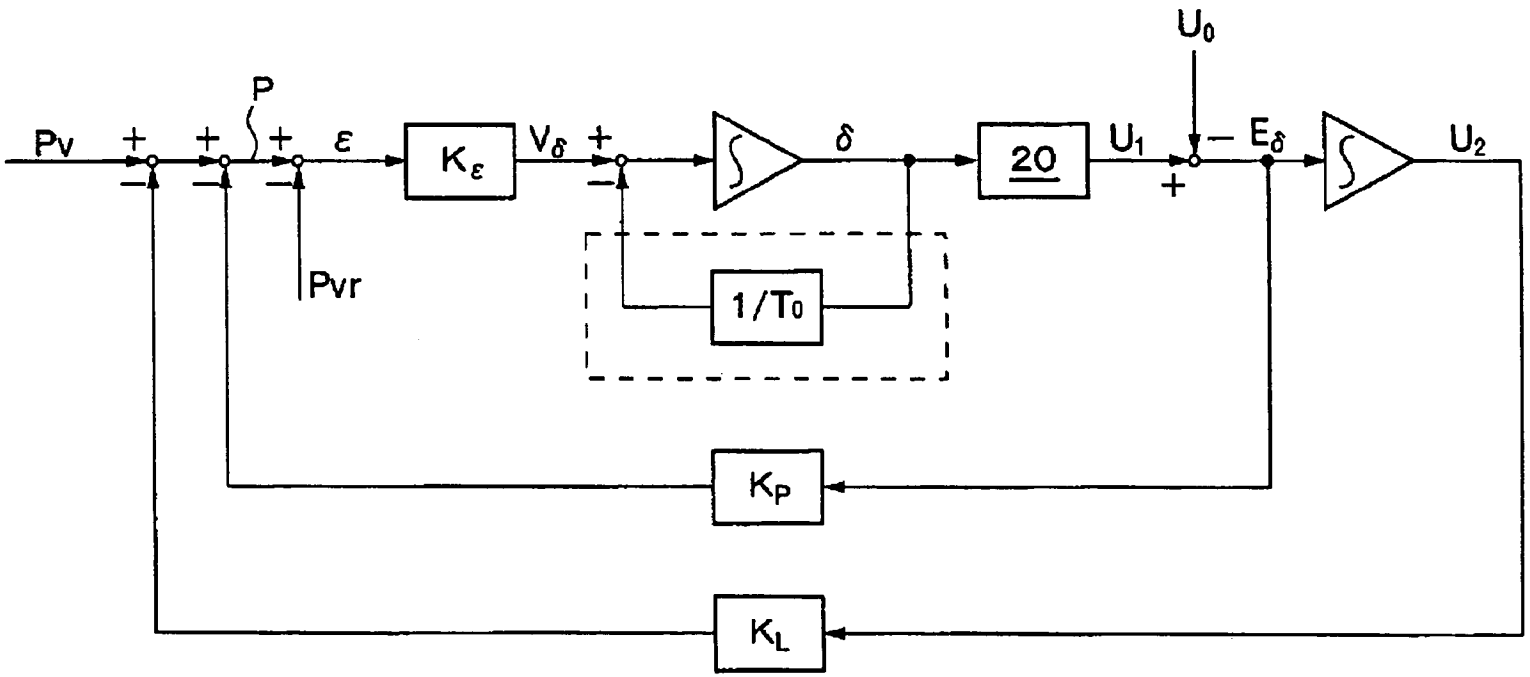
Figure 7:
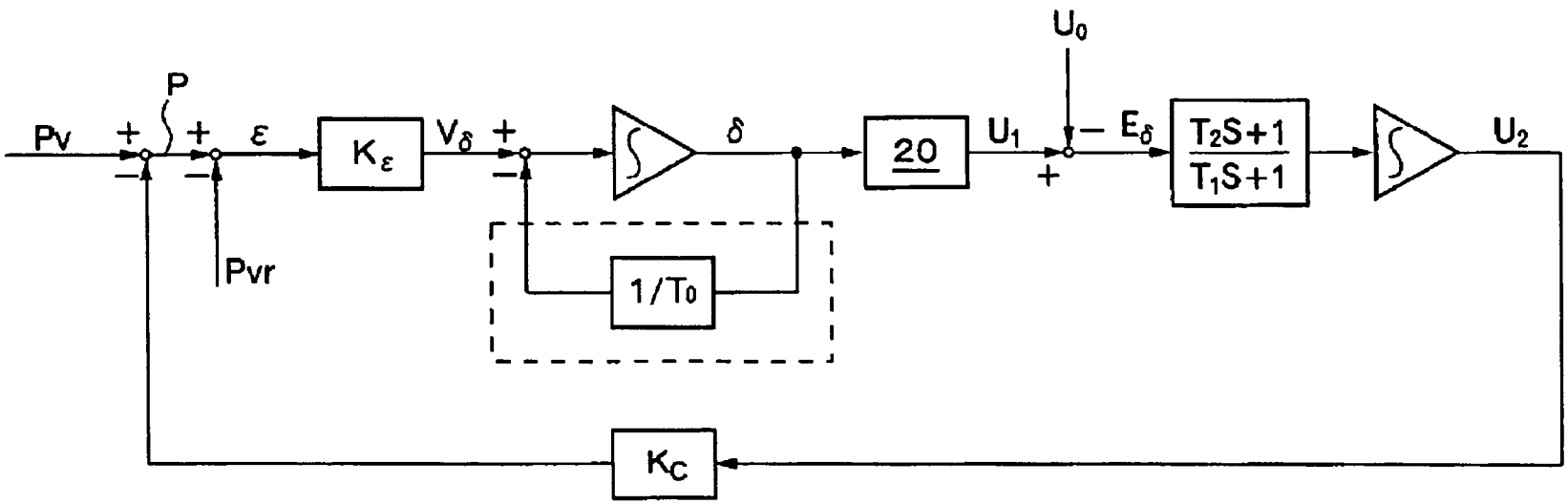
Figure 8:
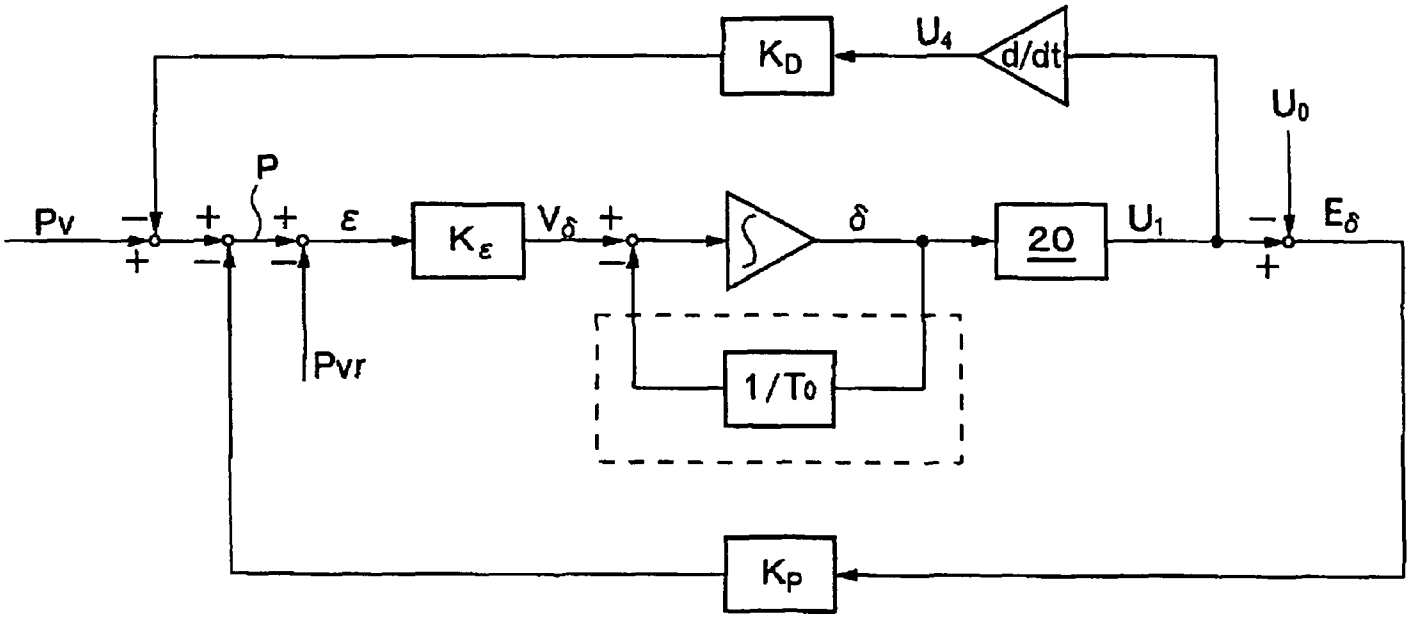

FIGS. 6 to 8 show a configuration of the polishing apparatus 1 of the configuration described above in which, even if the preestablished target shape of the polishing pad 13 cannot be retained due to error in the set shape-keep position Pv or characteristic changes in the dresser 30, the dressing position P obtained by feedback correction of the set shape-keep position Pv can be controlled or the shape-keep position Pv can be automatically updated to retain the undulation displacement δ of the polishing pad 13 to the target undulation displacement δT. In the first example shown in FIG. 6, a configuration in which the dressing position P is altered with respect to the shape-keep position Pv or a configuration for resetting the shape-keep position Pv based on calculation of the difference $E_\delta = U_1 - U_0$ between the undulation displacement δ of the polishing pad 13 measured by the pad shape measurement unit 20 (value $U_1$) and the set target undulation displacement δT (value taken as $U_0$) and, furthermore, employment of the value $U_2$ obtained by integration of this difference $E_\delta$ with the predetermined sample time t (for example, of a magnitude proportional to $U_2$) is adopted. Here, because a positive $U_2$ sign implies that the value of the measured undulation displacement δ of the polishing pad 13 is larger than the target undulation displacement δT, the dressing position P can be caused to approach (shift amount ∈ caused to approach 0) the true shape-keep position Pvr by decreasing the value of the dressing position P with respect to the existing set shape-keep position Pv and, as a result, the undulation displacement δ of the polishing pad 13 can be caused to approach the target undulation displacement δT. On the other hand, because a negative $U_2$ sign implies that the value of the measured undulation displacement δ of the polishing pad 13 is less than the target undulation displacement δT, the dressing position P can be caused to approach (shift amount ∈ caused to approach 0) the true shape-keep position Pvr by increasing the value of the dressing position P with respect to the existing set shape-keep position Pv and, as a result, the undulation displacement δ of the polishing pad 13 can be caused to approach the target undulation displacement δT. In the first example shown in FIG. 6, a so-called PI control system in which a value obtained by multiplying a predetermined proportional constant $K_p$ with $E_\delta$ and a value obtained by multiplying a predetermined proportional constant $K_L$ with $U_2$ is used for shift amount ∈ feedback is adopted.

In the second example shown in FIG. 7, a configuration in which the dressing position P is altered with respect to the shape-keep position Pv or a configuration for resetting the shape-keep position Pv based on calculation of the difference $E_\delta = U_1 - U_0$ between the undulation displacement δ of the polishing pad 13 measured by the pad shape measurement unit 20 (value $U_1$) and the set target undulation displacement δT (value $U_0$), and then passing of this difference $E_\delta$ through a phase compensation filter ($(T_2S+1)/(T_1S+1)$; $T_p$, $T_2$ are constants, S is a Laplace operator) and, furthermore, employment of the value $U_2$ obtained by integration of the value passing through this phase compensation filter with the predetermined sample time t (for example, of a magnitude proportional to $U_2$) is adopted (fluctuation relationship between the sign of $U_2$ and the dressing position P is the same as the first example). In this second example shown in FIG. 7, a system in which a value obtained by multiplying a predetermined proportional constant $K_c$ with the obtained value $U_2$ is used for shift amount ∈ feedback is adopted.

In addition, in the third example shown in FIG. 8, a configuration in which the dressing position P is altered with respect to the shape-keep position Pv or a configuration for resetting the shape-keep position Pv employing the difference $E_\delta$ between the undulation displacement δ of the polishing pad 13 measured by the pad shape measurement unit 20 (value $U_1$) and the set target undulation displacement δT (value $U_0$) (for example, of a magnitude proportional to the $E_\delta$) is adopted. Here, because a positive $E_\delta$ sign implies that the value of the measured undulation displacement δ of the polishing pad 13 is larger than the target undulation displacement δT, the dressing position P can be caused to approach (shift amount ∈ caused to approach 0) the true shape-keep position Pvr by decreasing the value of the dressing position P with respect to the existing set shape-keep position Pv and, as a result, the undulation displacement δ of the polishing pad 13 can be caused to approach the target undulation displacement δT. On the other hand, because a negative $E_\delta$ sign implies that the value of the measured undulation displacement δ of the polishing pad 13 is less than the target undulation displacement δT, the dressing position P can be caused to approach (shift amount ∈ caused to approach 0) the true shape-keep position Pvr by increasing the value of the dressing position P with respect to the existing set shape-keep position Pv and, as a result, the undulation displacement δ of the polishing pad 13 can be caused to approach the target undulation displacement δT. In the third example shown in FIG. 8, a so-called PD control system in which a value obtained by multiplying a predetermined proportional constant $K_p$ with $E_\delta$ and a value obtained by multiplying a predetermined proportional constant $K_D$ with a value $U_4$ obtained by differentiation of $U_1$ is used for shift amount ∈ feedback is adopted.

In the configuration of each of these three examples in which control of the position (dressing position P) of the dresser 30 with respect to the polishing pad 13 so that the shape of the polishing pad 13 obtained by shape measurement of the polishing pad 13 approaches the predetermined target shape is common thereto, even when the preestablished target shape of the polishing pad 13 cannot be retained due to set shape-keep position Pv error or characteristic changes in the dresser 30, the feedback-corrected dressing position P can be controlled with respect to the set shape-keep position Pv or the shape-keep position Pv can be automatically updated so that the undulation displacement δ of the polishing pad 13 is retained at the target undulation displacement δT.

Figure 9:
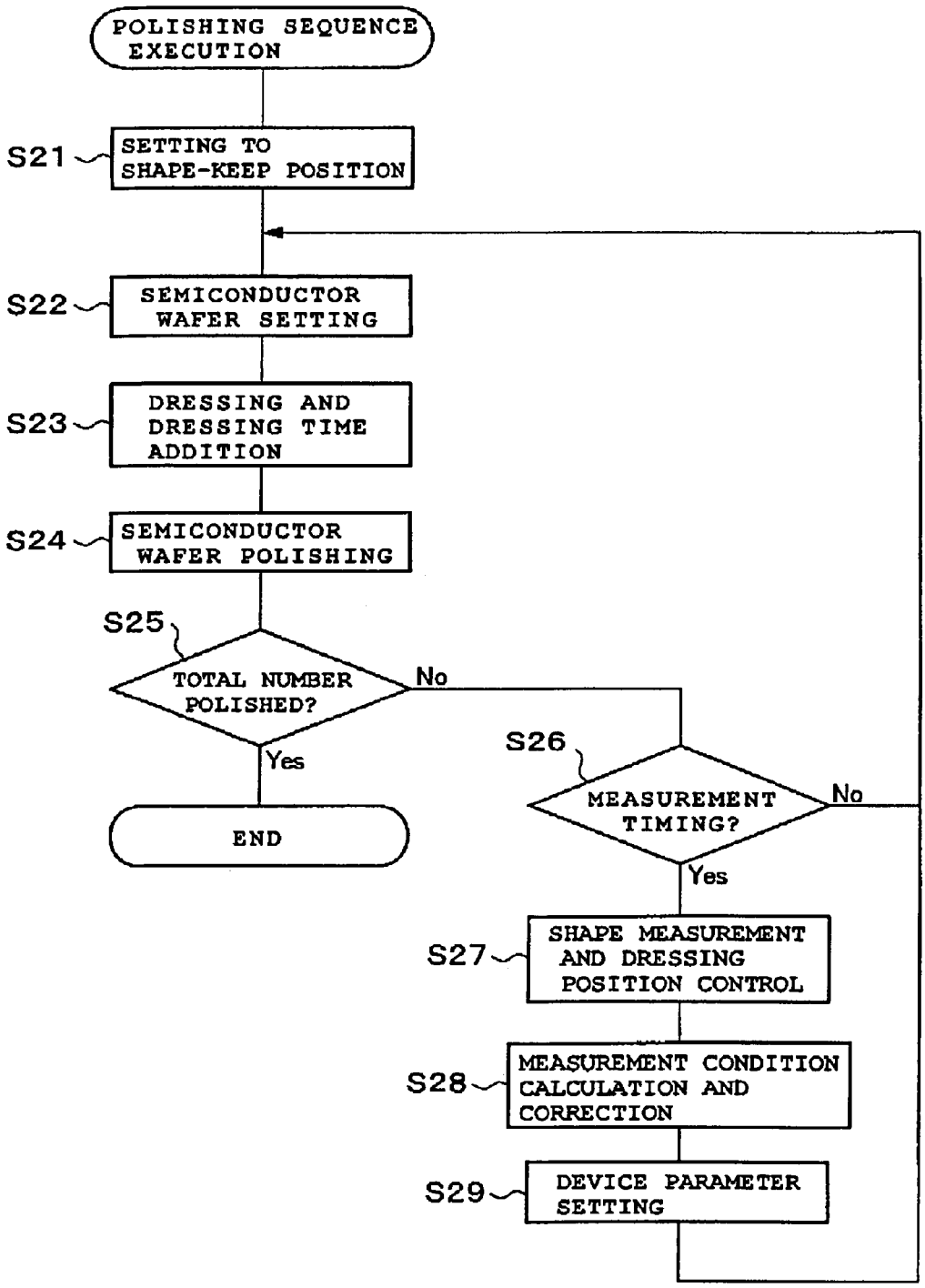
FIG. 9 is a flow chart of the polishing apparatus polishing sequence.

The semiconductor wafer W polishing sequence flow of this polishing apparatus 1 will be hereinafter described with reference to FIG. 9. The polishing sequence involves first of all the dresser 30 being set to the shape-keep position Pv with the polishing tool 10 (that is to say, the polishing pad 13) moved to the dressing station ST2 (Step S21). The shape-keep position Pv predetected by some method is set as an apparatus constant. In addition, in Step S21 (or at a stage prior to Step S21), a semiconductor wafer W interval number at which the timing at which shape measurement of the polishing pad 13 is implemented is established, and a total of semiconductor wafers W to be polished by the series of polishing steps is set. Here, for example, the interval number is set at 25 and the total number is set at 120.

Upon completion of Step S11, the process operation unit 70 is actuated so that the semiconductor wafer W to be subsequently polished is set onto the rotating support 40 (Step S22). Upon completion of Step S22, the polishing control unit 60 executes an actuation control of the polishing tool 10 and the dresser 30 for the polishing pad 13 to be dressed by the dresser 30 (Step S23). Simultaneously, the dressing time Td is measured, and the sum time ΣTd of the hitherto performed dressing time Td is calculated.

Upon completion of Step S23, the polishing control unit 60 moves the polishing tool 10 to the polishing station ST3, and the semiconductor wafer W set to the rotating support 40 in Step S22 is polished (Step S24). The semiconductor wafer W polishing is executed as a result of an actuation control of the rotating support 40 and polishing tool 10 by the polishing control unit 60.

Upon completion of Step S24, a judgment of whether or not the preset total number of semiconductor wafers W have been polished is made (Step S25). Here, while when the number of hitherto polished semiconductor wafers W has reached the total number the polishing sequence is completed, if the number of hitherto polished semiconductor wafers W point has not reached the total number the process advances to the next Step S26.

In Step S26, a judgment of whether or not the polishing of the semiconductor wafer W polished in the immediately preceding semiconductor wafer polishing (Step S23) corresponds to the timing number for shape measurement of the polishing pad 13 is made. Here, when the interval number is set as 25 and the total number is set as 120 as described above, the measurement timing numbers are, apart from the $1^{st}$ wafer, the $26^{th}$, $51^{st}$, $76^{th}$ and $101^{st}$ wafers. When there is an absence of correspondence with the measurement timing number, the process returns to Step S22 and the next semiconductor wafer W to be polished is set and, when there is correspondence with the measurement timing number, the process advances to the next Step S27.

In Step S27, the polishing tool 10 is moved to the pad shape measurement station ST1, and the undulation displacement δ, thickness th and groove depth de of the polishing pad 13 are measured by the pad shape measurement unit 20. The undulation displacement δ shown in FIG. 2 constitutes a value obtained by multiplying a difference length L between the outer diameter and inner diameter of the polishing pad 13 with a supplementary angle θ of a conical vertical angle obtained by conical shape approximation of the surface of the polishing pad 13. In addition, as shown in FIG. 2, the pad thickness th denotes the thickness from the average surface position of the polishing pad 13 to the surface of the plate 14 on which the polishing pad 13 is affixed. In addition, the groove depth de of the polishing pad 13 here denotes the average value of the depth d (see FIG. 2) of all of the grooves of the polishing pad 13. The dressing position P is controlled employing the control method outlined in the first to third examples or similar described above so that the shape of the polishing pad 13 obtained by the shape measurement of the polishing pad 13 approaches the preestablished target shape. The sample time employed here constitutes a sum time ΣTd of the dressing time Td calculated in the immediately preceding Step S23. For example, taking the interval number as 25 as described above and the dressing time performed on a single semiconductor wafer W as 10 seconds, the sample time is 250 seconds. The control of the feedback-corrected dressing position P with respect to the set shape-keep position Pv is based on actuation control of the pad shape measurement unit 20 executed by the measurement control unit 61 and polishing control unit 60.

Upon completion of Step S27, the polishing conditions are calculated and corrected (Step S28) is performed. Correlation data of polishing conditions based on undulation displacement δ of the polishing pad 13 and the thickness th of the polishing pad 13 and so on are prestored as a database in the storage unit of the polishing control unit 60 not shown in the diagram, and the optimum polishing conditions are calculated and corrected on the basis of the undulation displacement δ and thickness th of an immediately preceding measured polishing pad 13. These polishing conditions include the target undulation displacement δT of the polishing pad 13, the rotational speed of each of the polishing tool 10 and rotating support 40, the relative oscillating speed and oscillating width of the polishing tool 10, the magnitude of the pressure and the polishing time of the semiconductor wafer W on the polishing tool 10, and the slurry supply flow rate and flow amount.

Upon completion of Step S28, the measured data and control parameters (shape-keep position Pv and polishing conditions and so on) calculated on the basis of the data of Step S27 and Step S28 are set (updated) as new apparatus constants (Step S29). Upon completion of Step S29, the process returns to Step S22 and, subsequent to the next semiconductor wafer W to be polished being set, the steps for dressing and summing the dressing time (Step S23), polishing the semiconductor wafer W (Step S24), controlling the shape measurement and dressing position P of the polishing pad 13 (Step S27) and calculating the polishing conditions (Step S28) are repeated. When polishing the total number of semiconductor wafers W of Step S25 is judged to have been completed, the polishing sequence is completed.

In this way, the polishing apparatus 1 pertaining to the present invention comprises dressing control means (equivalent to the measurement control unit 61 and polishing control unit 60 of this embodiment) for dressing the polishing pad 13 using the dresser 30 in an intermediate process in a series of polishing steps for continuously polishing one or a plurality of polishing target objects by a polishing tool 10 every time the polishing of a plurality of semiconductor wafers W is completed, and dressing position control means (equivalent to the measurement control unit 61 and polishing control unit 60 of this embodiment) for measuring the shape of the polishing pad 13 by the pad shape measurement unit 20 whenever polishing a predetermined number (equivalent to the interval number in the example described above) of polishing target objects is completed, and controlling the position of the dresser 30 with respect to the polishing pad 13 so that the shape of the polishing pad obtained by the shape measurement of the polishing pad 13 approaches the preestablished target shape. By virtue of the polishing apparatus 1 pertaining to the present invention having the aforementioned configuration the step for machining the polishing pad 13 to the predetermined target shape is automatically performed and, unlike in the prior art, because of the absence of a step for finishing to a target shape based on the polishing steps being interrupted and then the polishing pad 13 being dressed by an operator on the basis of trial and error with the polishing steps of the polishing apparatus being interrupted, the polishing pad shape adjustment can be performed in a short time and the throughput of the polishing steps as a whole can be improved.

In addition, in this polishing apparatus 1 when the groove depth de of the polishing pad 13 is detected as having reached a preset depth $de_0$ on the basis of groove depth de information measured whenever polishing pad 13 dressing for a predetermined time Td has been completed, the polishing control unit 60 assumes that the usage lifespan of the polishing pad 13 has expired and executes an operation control of the process operation unit 70 for the polishing pad 13 to be replaced. After the polishing pad 13 is replaced, a step for machining the new polishing pad 13 is executed in accordance with the sequence described above.

In addition, while the grinding rate of the dresser 30 can be calculated in this polishing apparatus 1 by measuring the thickness th of the polishing pad 13, because a gradual drop in grinding rate normally occurs as the number of polishing target objects (here, the semiconductor wafers W) increases, a constant sharpened dresser 30 state can be maintained by increasing the dressing time whenever a semiconductor wafer W polishing is completed in proportion to this drop in the grinding rate.

In addition, because this polishing apparatus 1 comprises process operation means (equivalent to process operation unit 70 in this embodiment) for performing process operations such as conveyance and so on of the polishing target object (semiconductor wafer W) and polishing pad 13 and monitoring control means (equivalent to the monitoring control unit 62 of this embodiment) for monitoring the progress state of the polishing steps and executing an actuation control of process operation means in accordance with this progress state of the polishing steps and adjustments can be automatically made to the progress of the process operations during the time that is taken to set the dressing conditions and when delays occurs in the polishing steps themselves, the downtime of the polishing apparatus 1 can be reduced and, in turn, a reduction in costs can be achieved.

THIRD EXAMPLE

Figure 10:
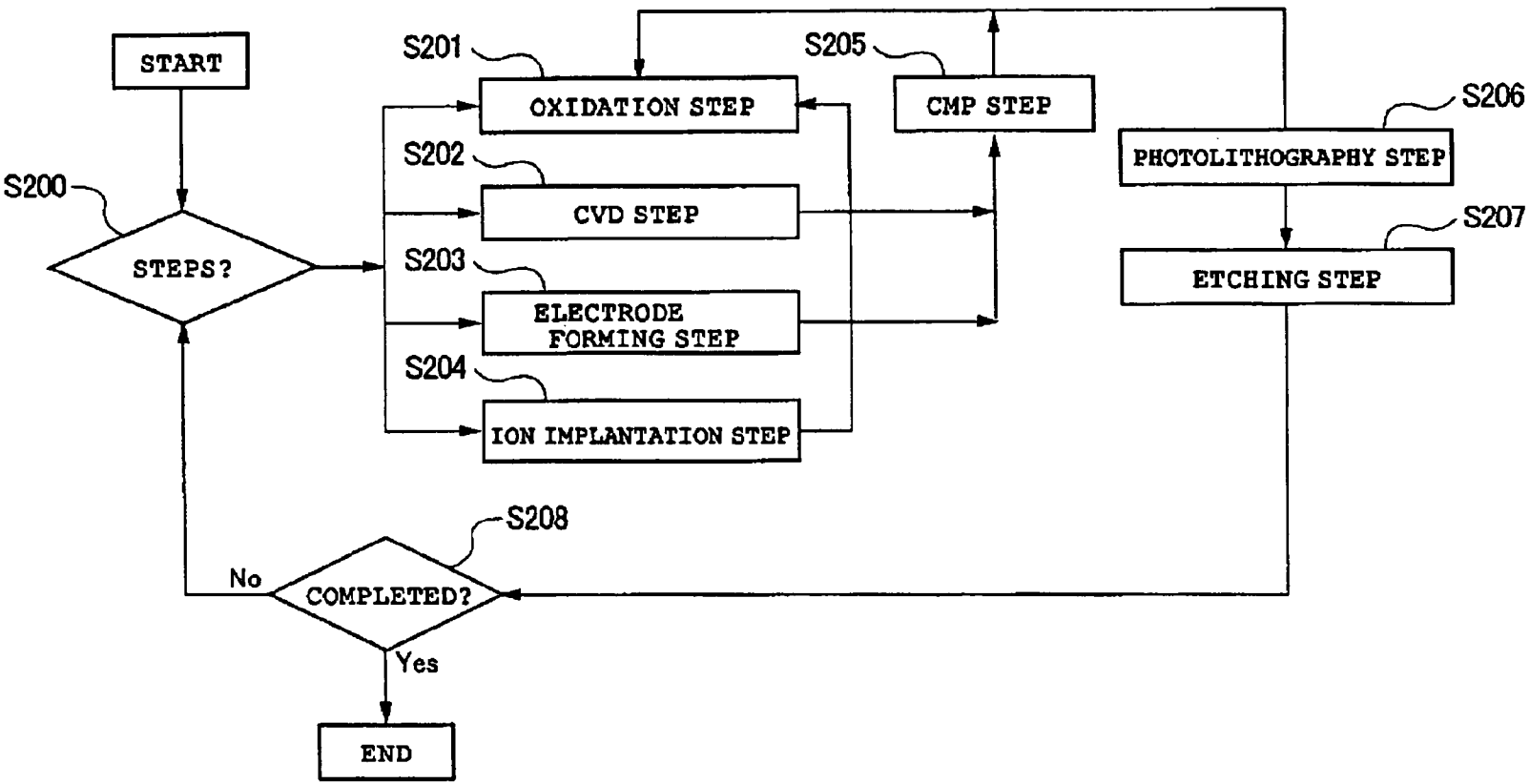
FIG. 10 is a flow chart showing an example of the method of manufacturing a semiconductor device pertaining to the present invention.

An embodiment of a method of manufacturing a semiconductor device pertaining to the present invention will be hereinafter described. FIG. 10 is a flowchart of the semiconductor device manufacturing process. When the semiconductor manufacturing process is started, first, in Step S200, a suitable processing step is selected from among the later described Steps S201 to S204, and the process advances to the thus-selected step. Here, the Step S201 constitutes an oxidation step for oxidizing the surface of a wafer. Step S202 is a CVD step for fabricating an insulation film or dielectric film on the wafer surface using a CVD or the like. Step S203 is a electrode-forming step for fabricating an electrode on the wafer by vapor-deposition or the like. Step S204 is an ion impregnation step for impregnating a wafer with ions.

Subsequent to the CVD step (S202) or electrode-forming Step (S203) being performed, the process advances to Step S205. Step S205 is a CMP step. In the CMP step, using the polishing apparatus 1 based on the present invention, a damascene structure is fabricated by smoothing an inter-layered insulation films and polishing the metal film of the surface of the semiconductor device, and polishing the dielectric film and so on.

Subsequent to the CMP step (S205) or oxidation step (S201) being performed, the process advances to Step S206. Step S206 is a photolithography step. In this step, a resist is coated on the wafer, a circuit pattern is printed onto the wafer by exposure employing an exposure device, and the exposed wafer is developed. The following Step S207 is an etching step in which the portion apart from the developed resist image is removed by etching, the resist is then peeled off, and the unnecessary resist following completion of the etching is removed.

Next, in Step S208, a judgment of whether all necessary steps have been completed is made and, if not all steps have been completed, the process returns to Step S200 and the previous steps are repeated to fabricate a circuit pattern on the wafer. If all steps are judged to have been completed in Steps S208, the process ends.

Because the polishing apparatus 1 pertaining to the present invention is employed in the polishing step (CMP step) of the semiconductor wafer W in the method of manufacturing a semiconductor device pertaining to the present invention, the throughput of the polishing steps of the semiconductor wafer W is improved, and the semiconductor device can be manufactured at a lower cost than using conventional method of manufacturing a semiconductor device. The polishing apparatus 1 pertaining to the present invention may be employed in CMP steps other than for the semiconductor device manufacturing process described above. In addition, because the semiconductor device pertaining to the present invention is manufactured by the method of manufacturing a semiconductor device pertaining to the present invention, a low cost semiconductor device can be manufactured.

While preferred embodiments of the present invention have been described above, the scope of the present invention should not be regarded as being limited to these embodiments. For example, while in the configuration of the polishing apparatus 1 pertaining to the embodiment described above the surface of the polishing target object mounted on the upper surface side of the rotating support 40 is polished by a polishing tool 10 that is positioned over the rotating support 40 and comprises on the lower face thereof the polishing pad 13, but a configuration in which the surface of a polishing target object mounted on the lower end of a spindle is polished by a polishing pad 13 mounted on an upper surface side of the rotating table positioned therebelow may be adopted. In addition, the object to be polished by the polishing apparatus 1 pertaining to the present invention, that is to say, the polishing target object, is not limited to a semiconductor wafer and may include other objects such as a liquid crystal substrate.

What is claimed is:

1. A polishing apparatus which comprises: a polishing tool on which a polishing pad is mounted; and polishing target object holding means for holding a polishing target object, and which polishes a surface of the polishing target object by a relative movement of the polishing tool and the polishing target object holding means with the polishing pad being in a state of contact with the polishing target object held by the polishing target object holding means, the polishing apparatus further comprising:

a dresser for dressing the polishing pad by bringing a rotated dressing surface thereof into contact with a surface of the polishing pad mounted on the polishing tool;

pad shape measurement means for measuring a shape of the polishing pad mounted on the polishing tool;

pad machining control means for, while acquiring data indicating a relationship between a dressing position defined by a distance between a rotating shaft of the polishing pad and a rotating shaft of the dresser and shape change of the polishing pad based on input of a target shape of the polishing pad and alternating repetition of dressing the polishing pad by the dresser and measurement of shape of the polishing pad by pad shape measurement means at a stage prior to commencement of a series of polishing steps for continuously polishing a plurality of the polishing target objects by the polishing tool, machining the polishing pad to the target shape while controlling the dressing position; and dressing position setting means for setting a dressing position during the polishing steps based on a processing result of the data.

2. The polishing apparatus according to claim 1, further comprising:

pad type detection means for detecting a type of the polishing pad mounted on the polishing tool based on a measurement of the polishing pad; and polishing condition setting means for setting polishing conditions of the polishing target object in accordance with a type of the polishing pad detected by the pad type detection means.

3. The polishing apparatus according to claim 1, characterized in that the dressing position setting means, based on the data indicating the relationship between dressing position and change in polishing pad shape, obtains a dressing position at which change in undulation displacement speed of the polishing pad is substantially zero and uses this dressing position as a criterion to set a dressing position at which polishing pad shape change is minimized.

4. The polishing apparatus according to claim 3, comprising:

pad type detection means for detecting a type of the polishing pad mounted on the polishing tool; and polishing condition setting means for setting polishing conditions of the polishing target object in accordance with a type of the polishing pad detected by the pad type detection means.

5. The polishing apparatus according to any of claims 1 to 4, comprising:

process operation means for performing process operations including conveyance of the polishing target object and the polishing pad; and monitoring control means for monitoring a progress state of the polishing steps, and executing an actuation control of the process operation means in accordance with the progress state of the polishing steps.

6. A method of manufacturing a semiconductor device, comprising a step of smoothing a surface of a semiconductor wafer serving as the polishing target object by using the polishing apparatus according to claim 1.

7. A semiconductor device, manufactured by the method of manufacturing a semiconductor device according to claim 6.

* * * * *

UNITED STATES PATENT AND TRADEMARK OFFICE

CERTIFICATE OF CORRECTION

PATENT NO. : 8,412,370 B2
APPLICATION NO. : 11/887454
DATED : April 2, 2013
INVENTOR(S) : Toshihisa Tanaka et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1464 days.

Signed and Sealed this
Seventeenth Day of February, 2015

Michelle K. Lee

Michelle K. Lee
*Deputy Director of the United States Patent and Trademark Office*